US011616329B2

(12) United States Patent
Copper et al.

(10) Patent No.: US 11,616,329 B2
(45) Date of Patent: Mar. 28, 2023

(54) POWER CONNECTORS WITH RECEIVING CHAMBER

(71) Applicant: FCI USA LLC, Etters, PA (US)

(72) Inventors: Charles Copper, Hummelstown, PA (US); Thomas Brungard, York, PA (US)

(73) Assignee: FCI USA LLC, Etters, PA (US)

( * ) Notice: Subject to any disclaimer, the term of this patent is extended or adjusted under 35 U.S.C. 154(b) by 0 days.

(21) Appl. No.: 17/114,074

(22) Filed: Dec. 7, 2020

(65) Prior Publication Data

US 2021/0194192 A1 Jun. 24, 2021

Related U.S. Application Data

(63) Continuation of application No. 16/427,943, filed on May 31, 2019, now Pat. No. 10,862,253, which is a (Continued)

(51) Int. Cl.
*H01R 24/76* (2011.01)
*H01R 12/55* (2011.01)

(Continued)

(52) U.S. Cl.
CPC ..... *H01R 24/76* (2013.01); *H01R 12/55* (2013.01); *H01R 12/716* (2013.01);

(Continued)

(58) Field of Classification Search
CPC ..... H01R 13/6583; H01R 24/60; H01R 13/6658; H01R 13/665; H01R 12/585
See application file for complete search history.

(56) References Cited

U.S. PATENT DOCUMENTS 3,172,718 A * 3/1965 Lalonde ..... H01R 12/585 439/634
3,760,329 A * 9/1973 Stepan ..... H01R 24/58 439/46

(Continued)

FOREIGN PATENT DOCUMENTS

CN 2508422 Y 8/2002
CN 2520579 Y 11/2002

(Continued)

OTHER PUBLICATIONS

Chinese Office Action for Chinese Application No. 201580069759.8 dated Aug. 3, 2018.

(Continued)

*Primary Examiner* — Truc T Nguyen
(74) *Attorney, Agent, or Firm* — Wolf, Greenfield & Sacks, P.C.

(57) ABSTRACT

A circular power connector that can accommodate plugs of varying diameters includes a plurality of electrical terminals that include a contact beam extending from and monolithic with base, where the contact beam includes a contact portion, and a mounting portion that extends from and monolithic with a base for mounting the terminal to a substrate. The terminals are cylindrically arranged to receive a plug. Alternatively, each electrical terminal includes a frame portion, a first contact beam extending from the frame in a first direction, and a second contact beam extending from the frame in a second direction. Multiple electrical terminals are oriented so that the first and second contact beams for one terminal extend at an angle, preferably perpendicular, to the first and second contact beams of another electrical terminal, in a still further embodiment, an electrical terminal having two halves is provided.

27 Claims, 18 Drawing Sheets

Related U.S. Application Data continuation of application No. 15/522,637, filed as application No. PCT/US2015/057527 on Oct. 27, 2015, now Pat. No. 10,312,647.

(60) Provisional application No. 62/069,037, filed on Oct. 27, 2014.

(51) Int. Cl.

| | |
|---|---|
| ***H01R 12/71*** | (2011.01) |
| ***H01R 13/11*** | (2006.01) |
| ***H01R 27/00*** | (2006.01) |
| ***H01R 24/86*** | (2011.01) |
| ***H01R 43/20*** | (2006.01) |
| *H01R 101/00* | (2006.01) |

(52) U.S. Cl.

CPC ..... *H01R 13/111* (2013.01); *H01R 24/86* (2013.01); *H01R 27/00* (2013.01); *H01R 43/20* (2013.01); *H01R 2101/00* (2013.01)

(56) References Cited

U.S. PATENT DOCUMENTS 3,955,875 A * 5/1976 Petiot ..... H01R 12/7082 439/631
4,077,694 A * 3/1978 Cobaugh ..... H01R 12/721 439/633
4,106,839 A 8/1978 Cooper
4,377,320 A 3/1983 Lathrop
4,538,878 A * 9/1985 Dambach ..... H01R 12/58 439/869
4,891,476 A 1/1990 Nation
4,946,403 A * 8/1990 Billman ..... H01R 12/83 439/631
5,024,609 A * 6/1991 Piorunneck ..... H01R 12/721 439/924.1
5,030,107 A * 7/1991 Moon ..... H01R 12/7076 439/62
5,199,895 A * 4/1993 Chang ..... H01R 12/83 439/636
5,259,795 A 11/1993 Yamada et al.
5,453,017 A * 9/1995 Belopolsky ..... H05K 3/3426 439/83
5,533,907 A * 7/1996 Kozel ..... H01R 12/721 439/637
5,836,773 A * 11/1998 McHugh ..... H01R 12/716 439/74
5,911,595 A 6/1999 Orr, Jr. et al.
5,931,689 A * 8/1999 Patel ..... H01R 13/20 439/74
5,997,367 A 12/1999 Nowak
6,010,369 A 1/2000 Itabashi
6,012,936 A * 1/2000 Siemon ..... H01R 24/64 439/676
6,135,785 A * 10/2000 Niitsu ..... H01R 12/716 439/74
6,139,351 A 10/2000 Schaefer et al.
6,267,606 B1 * 7/2001 Poplawski ..... G02B 6/4277 361/752
6,315,591 B2 * 11/2001 Oda ..... H01R 13/18 439/246
6,425,766 B1 7/2002 Panella
6,450,829 B1 9/2002 Weisz-Margulescu
6,461,174 B1 10/2002 Hwang
6,623,277 B1 9/2003 Zhu et al.
6,672,908 B2 * 1/2004 Okabe ..... H01R 12/716 439/744
6,775,151 B2 * 8/2004 Suzuki ..... H05K 9/006 361/752
7,008,235 B2 3/2006 Watanabe
7,413,456 B1 8/2008 DiFusco
7,488,198 B2 * 2/2009 Shiu ..... H01R 12/79 439/495
7,527,513 B1 * 5/2009 Okuyama ..... H01R 12/88 439/267
7,597,580 B1 10/2009 Advey et al.
8,057,263 B1 * 11/2011 Howard ..... H01R 12/721 439/631
8,061,862 B2 * 11/2011 Cho ..... G02F 1/133604 362/225
8,376,766 B1 * 2/2013 Huettner ..... H01R 12/91 439/248
8,435,077 B2 * 5/2013 Yang ..... H01R 12/737 439/637
8,783,368 B2 7/2014 Eriksen
9,004,946 B2 4/2015 Hoeppner
9,040,846 B2 5/2015 Suzuki et al.
9,083,107 B2 7/2015 Suzuki et al.
9,190,770 B2 * 11/2015 Shindo ..... H01R 13/631
9,263,199 B2 2/2016 Reuber
9,325,095 B2 4/2016 Glick
9,455,523 B1 9/2016 Sundarakrishnamachari et al.
9,559,467 B1 1/2017 Khorrami et al.
9,601,856 B2 3/2017 Regantini
9,711,299 B2 * 7/2017 Cortinovis ..... H01H 1/5866
10,312,647 B2 6/2019 Copper et al.
10,862,253 B2 12/2020 Copper et al.
2002/0039851 A1 * 4/2002 Mou ..... H01R 13/7032 439/188
2004/0229484 A1 11/2004 Uchida
2005/0037655 A1 2/2005 Henry et al.
2007/0105441 A1 5/2007 Shen et al.
2008/0242148 A1 * 10/2008 Omura ..... H01R 13/6581 439/598
2009/0197482 A1 8/2009 Mark
2009/0252489 A1 10/2009 Huang
2009/0318023 A1 12/2009 Block
2010/0081336 A1 * 4/2010 Hemmi ..... H01R 12/88 439/658
2010/0144172 A1 * 6/2010 Pavlovic ..... H01R 12/716 439/78
2010/0273345 A1 10/2010 Gong
2011/0155458 A1 6/2011 Kato et al.
2011/0159709 A1 6/2011 Polnyi
2011/0237101 A1 9/2011 Yang
2012/0089203 A1 4/2012 Shaffer
2012/0122339 A1 5/2012 Taguchi
2012/0208403 A1 * 8/2012 Hino ..... H01R 13/4538 439/626
2012/0228097 A1 * 9/2012 Gemme ..... H02B 11/04 200/50.23
2013/0210292 A1 8/2013 Schmidt
2013/0303033 A1 11/2013 Rong et al.
2014/0120763 A1 5/2014 Itsuki et al.
2014/0154912 A1 * 6/2014 Hirschy ..... H05K 9/0058 439/487
2014/0273628 A1 9/2014 de Chazal
2015/0132991 A1 * 5/2015 Crozier ..... H01R 12/7088 439/487
2016/0211057 A1 7/2016 Peterson et al.
2016/0329651 A1 11/2016 Yamaguchi et al.
2017/0310024 A1 10/2017 Adam
2017/0338606 A1 11/2017 Copper et al.
2018/0023981 A1 1/2018 Forwerck et al.
2018/0172141 A1 6/2018 Craft et al.
2018/0358731 A1 12/2018 Endo et al.
2019/0027871 A1 1/2019 Data et al.
2019/0044277 A1 2/2019 Mellott et al.
2019/0173221 A1 6/2019 de Chazal et al.
2019/0288466 A1 9/2019 Copper et al.
2022/0018215 A1 * 1/2022 Brackin ..... E21B 10/62

FOREIGN PATENT DOCUMENTS

CN 200965632 Y 10/2007
CN 101505017 A 8/2009
CN 101572359 A 11/2009
CN 101621168 A 1/2010
CN 201430276 Y 3/2010

(56) References Cited

FOREIGN PATENT DOCUMENTS

| | | | |
|---|---|---|---|
| CN | 101764294 | A | 6/2010 |
| CN | 102157809 | A | 8/2011 |
| CN | 201985279 | U | 9/2011 |
| CN | 102544836 | A | 7/2012 |
| KR | 10-2011-0103901 | A | 9/2011 |
| TW | M245634 | U | 10/2004 |
| WO | WO 2016/069570 | A2 | 5/2016 |

OTHER PUBLICATIONS

Chinese Office Action for Chinese Application No. 201580069759.8 dated May 24, 2019.
Communication pursuant to Article 94(3) EPC for European Application No. 15790778.3 dated May 22, 2019.
International Preliminary Report on Patentability for International Application No. PCT/US2015/057527 dated May 11, 2017.
International Search Report and Written Opinion for International Application No. PCT/US2015/057527 dated May 19, 2016.
Chinese Office Action for Chinese Application No. 202010928319.6 dated Jun. 23, 2021.
Chinese Office Action dated May 7, 2022 in connection with Chinese Application No. 202010928319.6.
CN 201580069759.8, Aug. 3, 2018, Office Action.
CN 201580069759.8, May 24, 2019, Office Action.
EP 15790778.3, May 22, 2019, Communication.
PCT/US2015/057527, May 19, 2016, International Search Report and Written Opinion.
PCT/US2015/057527, May 11, 2017, International Preliminary Report on Patentabiblity.
CN 202010928319.6, May 7, 2022, Office Action.
International Search Report and Written Opinion dated Nov. 8, 2022 in connection with International Application No. PCT/US2022/037558.
Brungard et al., Power Connector For Compact Electronic Systems, U.S. Appl. No. 17/867,647, filed Jul. 18, 2022.

* cited by examiner

POWER CONNECTORS WITH RECEIVING CHAMBER

RELATED APPLICATIONS

This Application is a Continuation of U.S. application Ser. No. 16/427,943 filed May 31, 2019, entitled "CIRCULAR POWER CONNECTORS", which is a continuation of U.S. application Ser. No. 15/522,637, filed Apr. 27, 2017, entitled "CIRCULAR POWER CONNECTORS", which is a national stage filing under 35 U.S.C. 371 of International Patent Application Serial No. PCT/US2015/057527, filed Oct. 27, 2015, entitled "CIRCULAR POWER CONNECTORS", which is a Non-Provisional of Provisional (35 U.S.C. 119(e)) of U.S. Application Ser. No. 62/069,037, filed Oct. 27, 2014, entitled "CIRCULAR POWER CONNECTORS". The entire contents of the foregoing are hereby incorporated herein by reference.

TECHNICAL FIELD

The inventions described and claimed herein relate to circular electrical connectors used in power transfer.

BACKGROUND

Electrical connection typically involves abutting two conductive mating surfaces in order to establish current flow from one surface to the other. When such a connection is used to transfer power, i.e., relatively higher current levels, in an electrical circuit, contact resistance becomes a significant factor. Lower resistance has been said to effect lower power losses and lower temperatures. In the past, it has been proposed to lower contact resistance by increasing the size of the mating surfaces, by increasing the normal force between the mating surfaces and by increasing the smoothness of the mating surfaces to increase the percentage of contact between the mating surfaces.

In circular electrical connectors used to transfer power, it has been proposed to lower contact resistance by increasing the number of points of contact between the receptacle and the plug. Along this line, it has been proposed for the receptacle to include a number of conductors designed and oriented to contact the inserted plug. The problem with such prior circular power connectors has been the need to create relatively expensive machined parts to accommodate plugs of varying diameter.

SUMMARY

In one embodiment a simplified electrical power terminal can include a base and a contact beam extending from the base and monolithic with the base, where the contact beam includes a contact portion and where the contact portion includes a first side and a second side angled relative to one another. The distance between said first and second sides becomes greater along the contact portion in a direction away from the base. The preferred contact beam also includes an insertion portion on the end of the contact portion furthest from the base, where the insertion portion includes first and second sides angled relative to one another. The distance between the first and second sides becomes smaller along the insertion portion in a direction away from the base. The electrical power terminal can be manufactured by stamping.

In one embodiment, electrical connector includes an electrically insulative connector housing defining a receiving chamber and a plurality of electrical terminals supported by the connector housing. Each of the electrical terminals includes a body having a base and a contact beam extending from the base. The contact beam includes a contact portion having first and second sides angled relative to one another. The electrical terminals are positioned in the housing in relation to the receiving chamber so that at least a portion of the first side extends into the chamber. It is preferred for the electrical terminals to include an insertion portion on the end of the contact portion furthest from the base where the insertion portion includes first and second sides angled relative to one another.

In another embodiment, the connector housing defines an angled surface surrounding the receptacle opening.

In a still further embodiment the electrical terminal body used in the connector includes an anchor portion for anchoring the body to the connector housing. In such an embodiment, the anchor portion can include a toothed surface for contacting an inner surface of passages formed in the connector housing.

An alternate embodiment of an electrical terminal includes an electrically conductive monolithic body including a frame portion, a first contact beam extending from the frame portion in a first direction, and a second contact beam extending from the frame in a second direction. The first and second contact beams include contact portions, where the contact portions are positioned generally opposite one another. In such an embodiment, it may be preferred for the contact portions to include projections formed on the ends of the contact beams. In such an embodiment it is especially preferred for the contact portions to include a rounded surface. In this embodiment, it is also preferred for the first and second contact beams to include an arm portion and an extension portion, where the arm portions of the first and second contact beams extend in first and second direction. It is especially preferred for the extension portions to be arcuate shaped.

An electrical connector constructed using this alternate terminal includes an electrically insulative connector housing defining a receiving chamber where a plurality of electrical terminals are supported by the connector housing and where the electrical terminals are positioned in the housing in relation to a receiving chamber so that at least a portion of the contact portions extends into the chamber. In such a connector, it is preferred for at least one of the electrical terminals to be oriented so that the directions along which the first and second contact beams extend are at an angle, preferably perpendicular, to the first and second directions of another electrical terminal in the housing.

An alternate embodiment of an electrical terminal includes an electrically conductive monolithic body including a frame portion, a first contact beam extending from the frame portion in a first direction, and a second contact beam extending from the frame in a second direction, where the first and second contact beams including contact portions. An electrical connector constructed using this alternate terminal includes an electrically insulative connector housing defining a receiving chamber and a plurality of electrical terminals supported by the connector housing where the electric terminals are positioned in said housing in relation to said receiving chamber so that at least a portion of said contact portions extend into said chamber. In such a connector it is preferred for the receiving chamber to define a central axis and wherein at least one of the electrical terminals is oriented so that the contact portions of extend into the receiving chamber at positions around the central axis that are different than the positions of the contact portions of another of the electrical terminals.

A still further alternate embodiment of an electrical terminal includes an electrically conductive monolithic body including a frame portion, where the frame portion defines an opening, and having a plurality of contact beams each having a contact portion on the end thereof, wherein the contact beams extend from the frame portion so that the contact portions are positioned in the opening. An electrical connector constructed using this alternate terminal includes an electrically insulative connector housing defining a receiving chamber and a plurality of electrical terminals supported by the connector housing, where the electric terminals are positioned in the housing in relation to the receiving chamber so that at least a portion of the contact portions extend into the chamber.

The previous alternative embodiment lends itself to a method for constructing receptacle connectors to receive plug connectors of various sizes. The method includes inserting a plurality of electrical terminals into first and second electrically insulative housings wherein the first housing defines a receptacle chamber of a first size and an opening to the chamber and wherein the second housing defines a receptacle chamber of a second size and an opening to the chamber and wherein the terminals each include an electrically conductive monolithic body including a frame portion, a first contact beam extending from the frame portion in a first direction, and a second contact beam extending from the frame in a second direction, where the first and second contact beams including contact portions; and positioning the electric terminals in the first and second housings in relation to the receiving chambers so that the contact portions of at least one of the electrical terminals extend into one side of the chamber and further so that the contact portions of at least one other of the electrical terminals extend into the chamber on a different side where the electric terminals positioned in the second housing are spaced further apart than the electric terminals positioned in the first housing.

BRIEF DESCRIPTION OF THE DRAWINGS

The foregoing summary, as well as the following detailed description of example embodiments of the application, will be better understood when read in conjunction with the appended drawings, in which there is shown in the drawings example embodiments for the purposes of illustration. It should be understood, however, that the application is not limited to the precise arrangements and instrumentalities shown. In the drawings.

DETAILED DESCRIPTION OF ILLUSTRATIVE EMBODIMENTS

Figure 1:
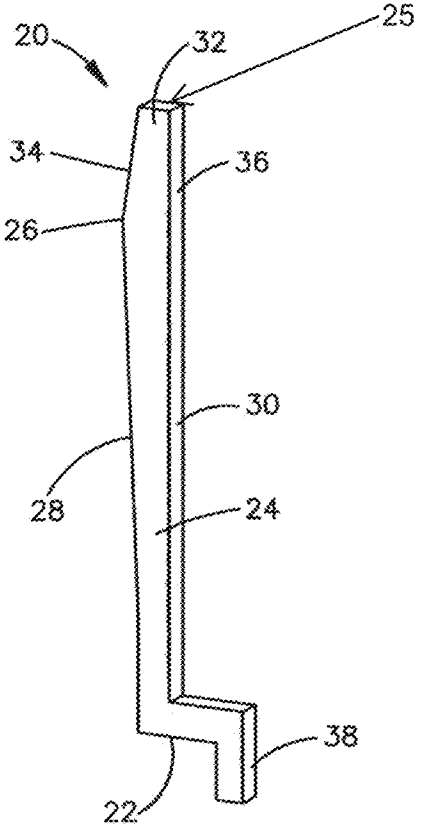
FIG. 1 is a perspective view of an electrical terminal constructed in accordance with one embodiment.

Referring to FIG. 1, an electrical power terminal 20 is shown. Terminal 20 is an electrically conductive monolithic body. It should be appreciated, however, unless otherwise indicated, that various components of the terminal 20 can be separate from one or more other components of the terminal as desired. Preferably, the terminal 20 is constructed in a stamping operation. In such an operation sheet metal, which can be stainless steel, tin, copper, alloys including the same, or any alternative suitable electrically conductive material, is stamped to form the terminal 20. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

The power terminal 20 can include a base 22 and a contact beam 24 that extends from the base 22. The base 22 and the contact beam 24 can be monolithic with each other. The contact beam 24 defines a contact portion 26 that is configured to contact a complementary electrical power terminal that is mated with the power terminal 20. The complementary power terminal can be supported by a plug housing of a plug connector that is received by a receptacle connector that includes the power terminal 20. The contact portion 26 includes a first side 28 and a second side 30. The first side 28 can be referred to as a first contact side, and the second side 30 can be referred to as a second contact side. The first side 28 can be opposite the second side 30. For instance, the first side 28 can be spaced radially inward with respect to the second side 30 when the power terminal 20 is supported by a connector housing, as described in more detail below. The first and second sides 28 and 30 can further be oriented at an angle relative to each other. For instance, the first side 28 can angled with respect to the second side 30. The second side 30 extends along an axial direction. The first side 28 can extend along a direction that is angularly offset with respect to the axial direction. In one example, the first side 28 can be angled relative to the second side 30 such that the width of terminal 20 or the distance from the first side 28 to the second side 30 becomes greater along the contact portion 26 in a direction away from base 22. Otherwise stated, the first side 28 can flare away from the second side 30 as it extends in a direction away from the base 22.

The contact beam 24 can further include an insertion portion 32 disposed at the end of power terminal 20 furthest from base 22. Thus, the contact portion 26 can be disposed between the base 22 and the insertion portion 32. The insertion portion 32 can define a first side 34 and a second side 36. The first side 34 can be referred to as a first insertion side, and the second side 36 can be referred to as a second insertion side. The first side 34 can be opposite the second side 36. For instance, the first side 34 can be spaced radially inward with respect to the second side 36 when the power terminal is supported by the connector housing. The first and second sides 34 and 36 can further be oriented at an angle relative to each other. For instance, the first side 34 can be angled with respect to the second side 36. The second side 36 can extend along the axial direction. In one example, the second side 30 of the contact portion 26 can be continuous and coplanar with the second side 36 of the insertion portion 32. The first side 34 can extend along a direction that is angularly offset with respect to the second side 36. In one example, the first side 34 can be angled relative to the second side 36 such that the width of terminal 20 or the distance from the first side 34 to the second side 36 becomes smaller along the insertion portion 32 in a direction away from base 22. Otherwise stated, the first side 34 can flare toward the second side 36 as it extends in a direction away from the base 22. It should thus be appreciated that the first side 28 of the contact portion 26 and the first side 34 of the insertion portion 32 join together at an interface 25 that can be defined by an apex of the contact beam 24. The first surface 28 can flare toward the second surface 30 from the interface 25 in a direction toward the base 22, and the first surface 34 can flare toward the second surface 36 from the interface 25 in a direction away from the base 22.

The power terminal 20 can further include a tail portion 38. Tail 38 can extend away from base 22. Though the tail 38 can extend away from the base 22 in a direction opposite the contact beam 24, the direction of the tail 38 is not so limited. For instance, as described in more detail below (see, e.g., FIG. 6), the tail 38 can extend away from the base in the same direction as the contact beam 24. The tail 38 serves to provide an electrical connection between terminal 20 and an electrical circuit. The tail 38 can have any number of shapes and extend in virtually any direction without departing from the invention. Examples of a few of such embodiments are described below. Indeed, tail 38 may even include a shortened length or stub intended to cooperate with solder balls and the like to electrically connect terminal 20 to an electrical circuit. The electrical circuit can be carried by a substrate, for instance to define a printed circuit board. Alternatively, the electrical circuit can be configured as any suitable alternative electrical circuit as desired.

Figure 2:
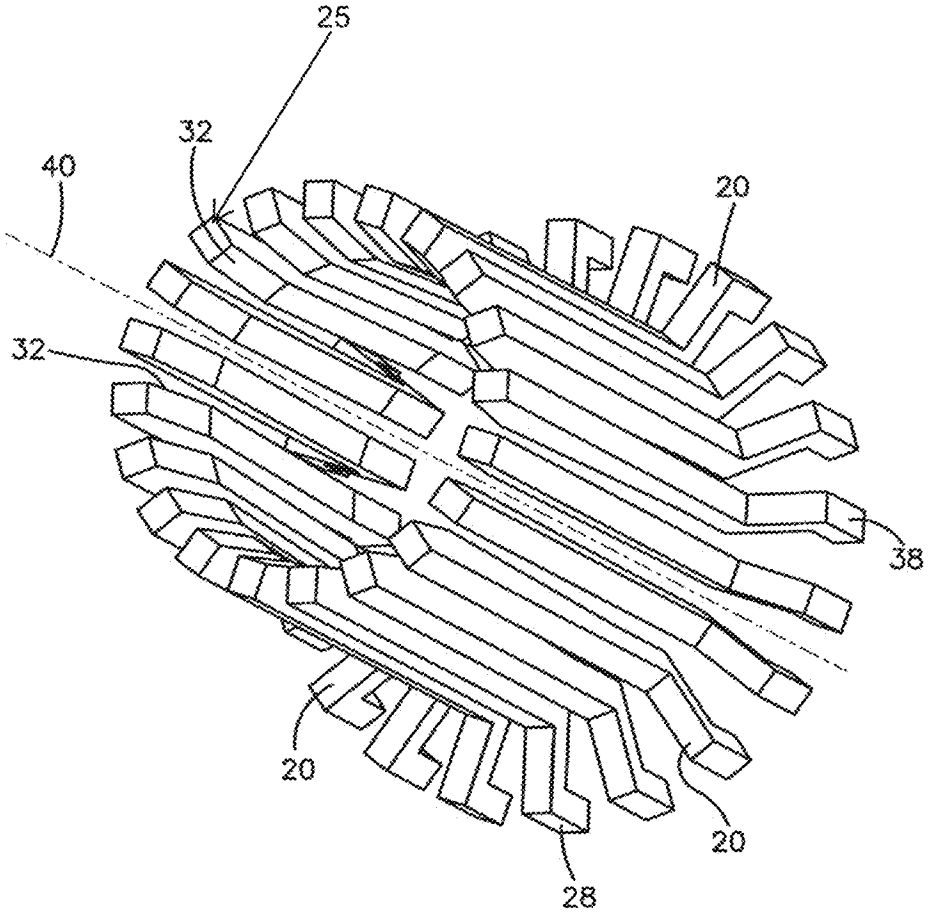
FIG. 2 is a perspective view of plurality of terminals depicted in FIG. 1, arranged in a pattern for mating with a cylindrical plug.

Referring now to FIG. 2, the power terminal 20 is configured such that when a plurality of the power terminals 20 are positioned in a cylindrical arrangement, the various insertion portions 32 act to locate and center a plug being inserted into the cylindrical arrangement. For instance, the plurality of power terminals 20 are positioned around and in relation to a central axis 40. The central axis 40 can extend along the axial direction. With such positioning, the insertion portions 32 will act to locate and center a cylindrical plug inserted generally along axis 40 in a direction from the insertion portions 32 toward the respective bases 22. For instance, the plug can ride along certain ones of the first sides 34, such that the plug makes physical contact with each of the interfaces 25, which can define contact points with the plug.

Figure 3:
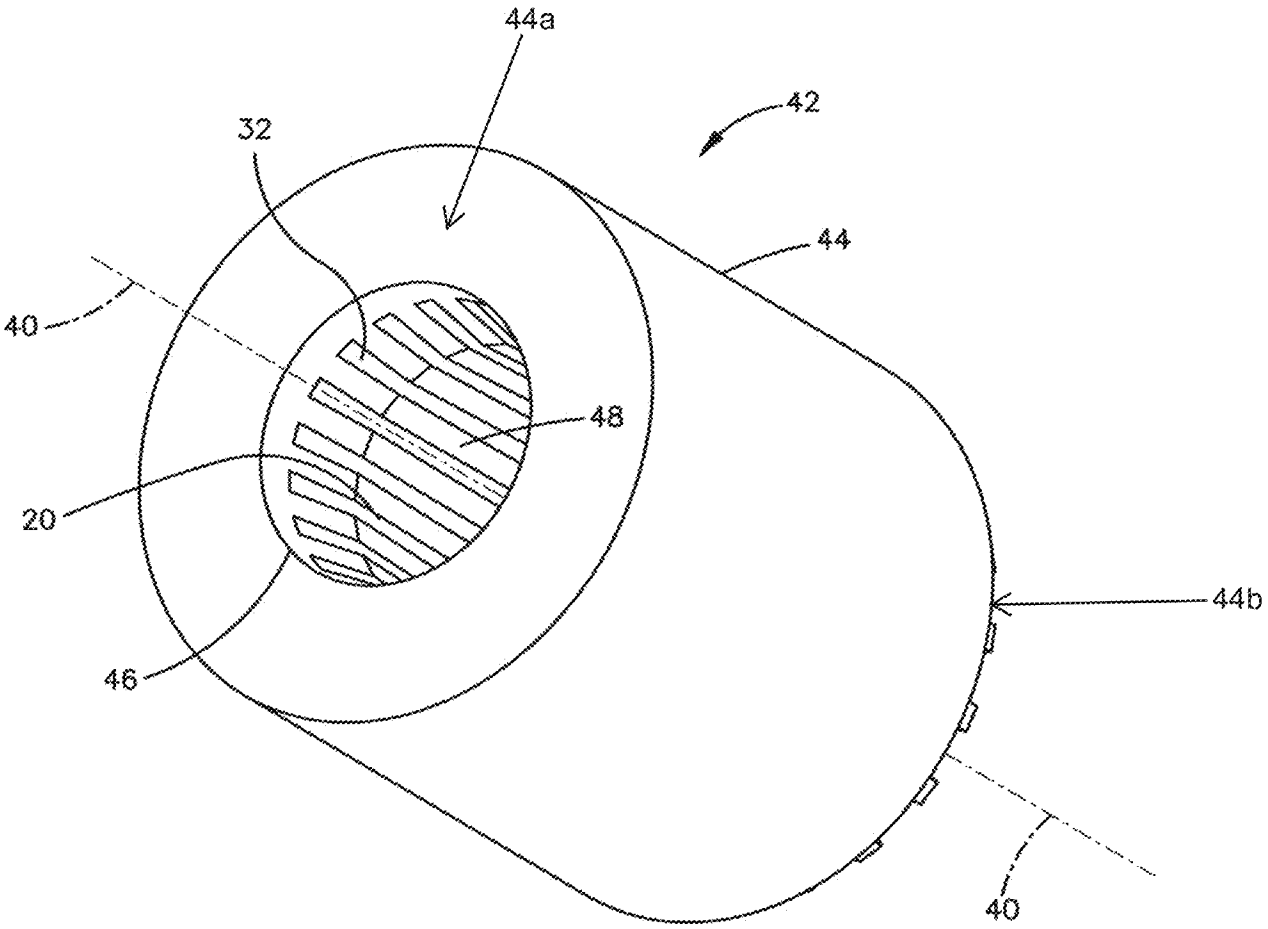
FIG. 3 is a perspective view of a circular power connector incorporating the arrangement of terminals depicted in FIG. 2.

Referring to FIG. 3, an electrical connector 42 can include a connector housing 44 and the plurality of power terminals 20 supported by the connector housing 44. For instance, the plurality of power terminals 20 can be supported by the connector housing in the cylindrical arrangement. The connector housing 44 can be made from any suitable dielectric or electrically insulative material. For instance, the connector housing 44 can be a plastic. Alternatively, the connector housing can be electrically conductive. For instance, the connector housing can be metallic. It should be appreciated that the connector housing 44 can be alternatively made of any suitable material. The connector housing 44 can be annular or otherwise shaped as desired. In one example, the connector housing 44 can define a mating interface 44*a* and a mounting interface 44*b* opposite the mating interface 44*a*. The connector housing 44 can define a receiving chamber 48 that extends from the mating interface 44*a* along a direction toward the mounting interface 44*b*. The connector housing 44 can further define an opening 46 to the receiving chamber 48. The opening 46 can be defined at the mating interface 44*a*. The power terminals 20 can be positioned in housing 44 so that the insertion portions 32 are positioned proximate the opening 46. It is noted that in addition to locating and centering a plug inserted through opening 46 and into chamber 48, insertion portions 32 also act to deflect contact beams 24 away from the central axis 40 during an insertion operation. For instance, as the plug is inserted through the opening 46 and into the receiving chamber 48, the plug can ride along the insertion portion 32, such as the first surface 34, and bias the insertion portions 32 radially outward away from the central axis 40. Although insertion portion 32 is depicted in FIG. 1 as a relatively flat surface, in other disclosed embodiments, insertion portion 32 can be formed as a rounded or curved surface.

Figure 4:
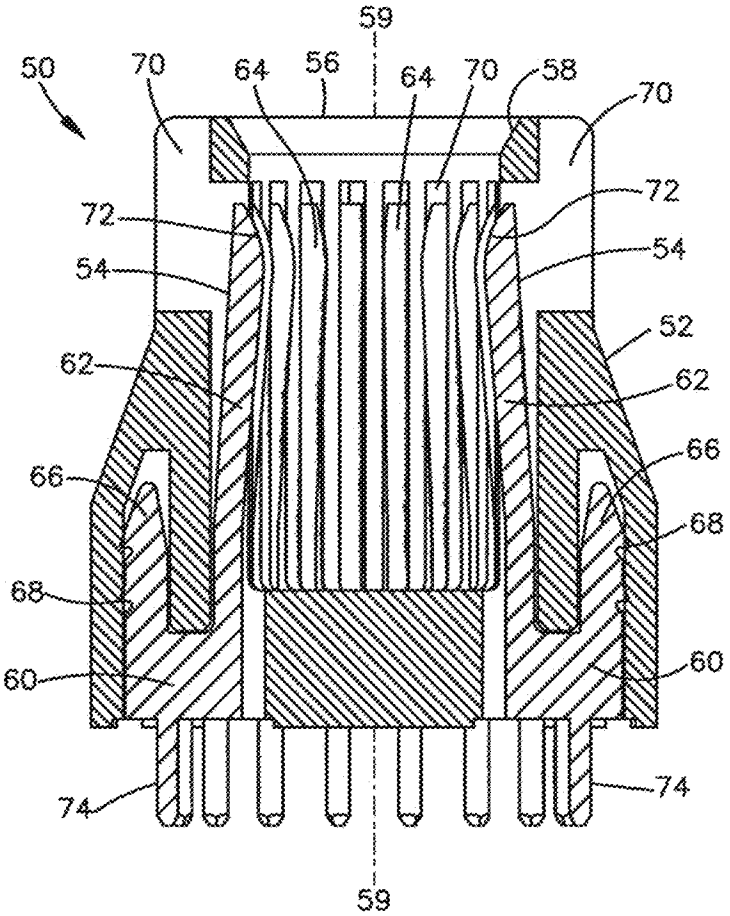
FIG. 4 is a section view perspective view of a circular power connector incorporating an alternative electrical terminal than that depicted in FIG. 3.

Referring now to FIG. 4, an electrical connector 50 is shown to include a dielectric or electrically insulative connector housing 52 and a plurality of electrical terminals 54 supported by connector housing 52. Housing 52 defines an opening 56 to a receiving chamber 57. The diameter of opening 56 is preferably sized to permit passage of a power plug into chamber 57. Housing 52 is also shown to define an angled surface 58 surrounding opening 56. Surface 58 also acts to locate and center a plug being inserted into connector 50. Opening 56, the receiving chamber and angled surface 58 preferably are centered around an insertion axis 59.

As also shown in FIG. 4, each terminal 54 includes a body having a base 60 and a contact beam 62 extending from the base. Preferably, each contact beam 62 extends away from base 60 at an angle towards insertion axis 59. Each contact beam 62 includes a contact portion 64 for contacting a plug inserted into connector 50. In this embodiment, contact portion 64 is formed as a curved or arcuate surface on beam 62. It is further preferred for each contact beam to be angled in relation to insertion axis 59 such that contact portion 64 extends in the receiving chamber. It is noted that the degree by which contact beam 62 is angled towards insertion axis 59 and the degree by which contact portion 64 extends in the receiving chamber, in combination, will provide a minimum normal or contact force upon a plug inserted into the receiving chamber.

Each terminal 54 also includes an anchor portion 66 for anchoring the terminal body to housing 52. Each anchor extends away from base 60 and preferably includes a toothed surface having one or more teeth 68. Terminals 54 are positioned in housing 52 through their placement within a series of slots or passages 70 formed in housing 52. Although, slots or passages 70 are depicted, it should be understood that housing 52 could also be formed on terminals 54 by an over-molding operation without departing from the invention. Passages 70 are preferably formed in housing 52 so that terminals 54 are arranged cylindrically about insertion axis 59. As shown, passages 70 are sized to allow for the deflection of contact beams 62 in a direction away from insertion axis 59 during insertion of a plug.

Each terminal 54 also includes insertion portion 72 formed on the end of contact beam 62 furthest from base 60. As shown, insertion portion 72 forms an extension of the curved or arcuate surface of contact portion 64. Terminals 54 are positioned in housing 52 so that insertion portions 72 are positioned proximate opening 56. Terminals 54 are positioned in housing 52 in relation to the receiving chamber so that said at least a portion of the surface of insertion portions 72 extends into the receiving chamber. It is noted that in addition to locating and centering a plug inserted through opening 56 and into the receiving chamber, insertion portions 72 also act to deflect contact beams 62 away from the insertion axis 59 during an insertion operation.

Terminals 54 are also shown to include a tail portion 74. Tail 74 extends away from base 60. Tail 74 serves to provide an electrical connection between terminal 54 and a substrate, which can carry an electrical circuit. The substrate can be configured as a bus bar, a printed circuit board, or alternatively configured substrate as desired. For instance, the substrate can be configured as a flat substrate. Although tail 74 is depicted as extending away from base 60 in a direction generally opposite to contact beam 62, the direction of tail 74 is not so limited. Tail 74 can have any number of shapes and extend in virtually any direction without departing from the invention. It is noted that the combination of housing and terminals capable of mounting on a substrate or interface now permits the use of stamped terminals to accommodate power plugs. By sizing the housing and selecting a number of stamped contacts that correlates to the size of the housing, an electrical connector can be fashioned to accommodate varying size plugs and be mounted to a substrate as described herein.

Figure 5:
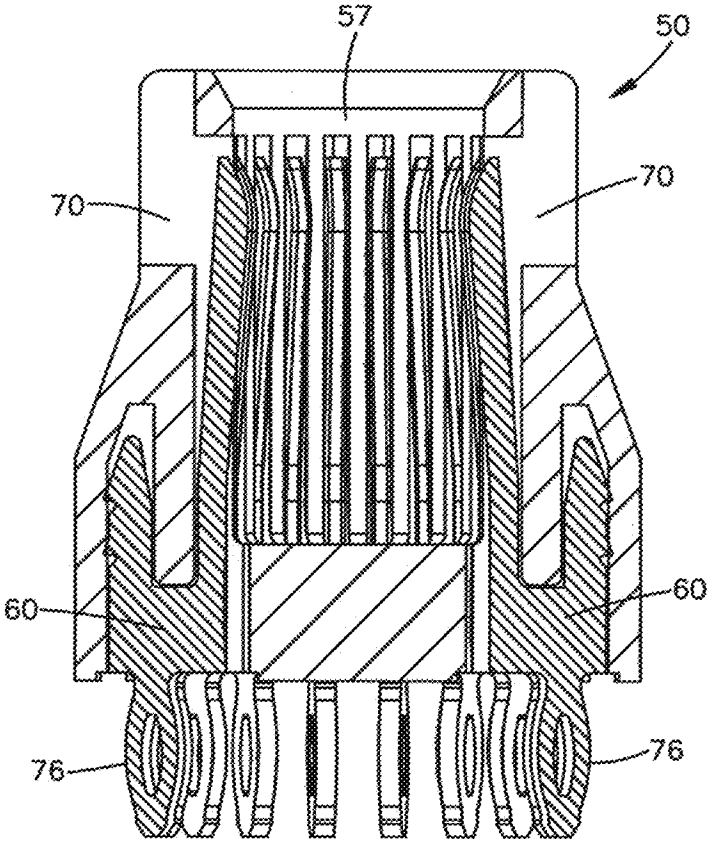
FIG. 5 is a section view perspective view of a circular power connector incorporating an alternative electrical terminal than that depicted in FIG. 3.
Figure 7:
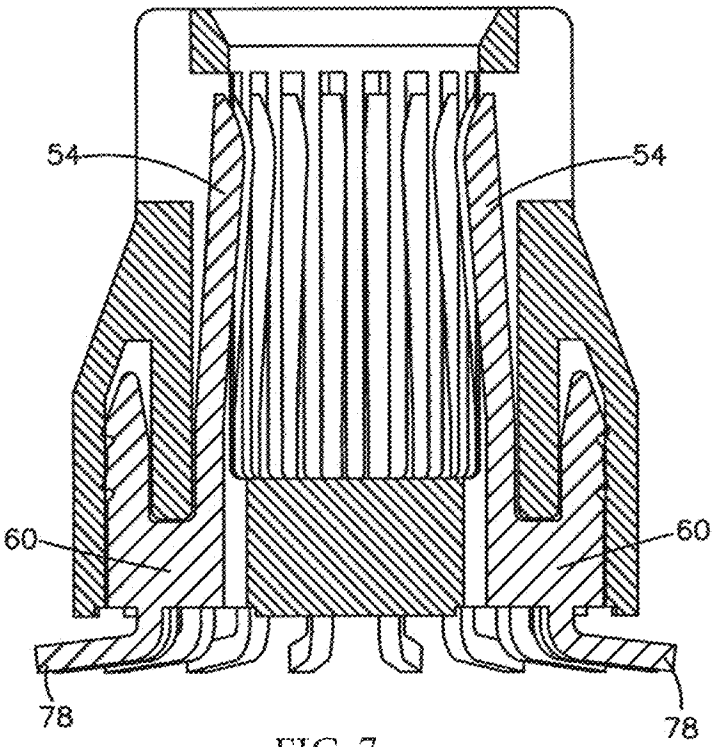
FIG. 7 is a section view perspective view of a circular power connector incorporating an alternative electrical terminal than that depicted in FIG. 3.
Figure 6:
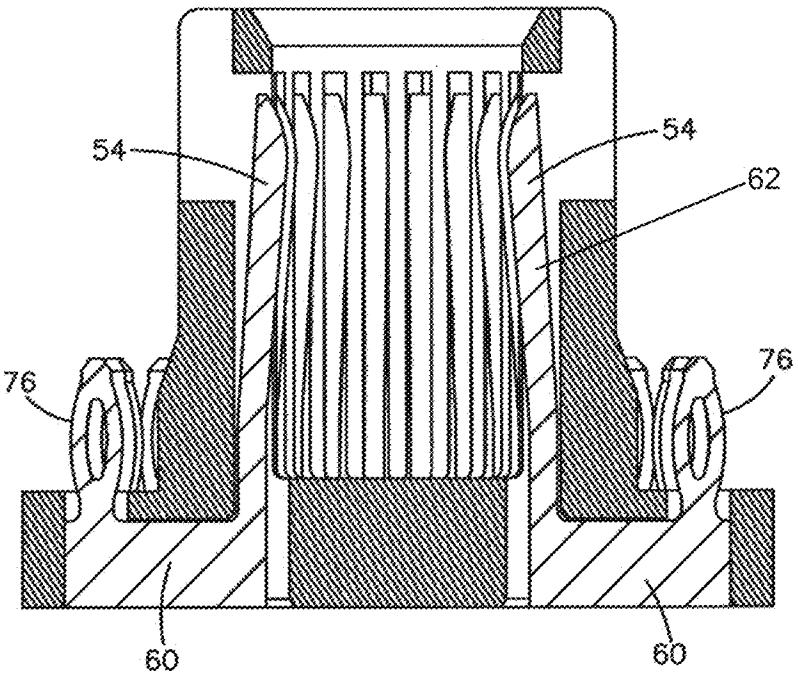
FIG. 6 is a section view perspective view of a circular power connector incorporating an alternative electrical terminal than that depicted in FIG. 3.

In FIG. 5, the connector 50 is shown to include terminals 54 having tails that are formed as press fit tails 76. In certain applications, it is not desirable to use terminals having tails extending beyond the connector. In FIG. 6, connector 50 is shown to include terminals 54 having tails that are formed as press fit tails 76 and which extend from base 60 in generally the same direction as contact beams 62. In other applications, it is desirable to assemble connectors onto printed circuit boards and the like using surface mount techniques. In FIG. 7, connector 50 is shown to include terminals 54 having tails that are directed away from base 60 at a sharp angle thereby providing a platform like arrangement to facilitate mounting connector 50 using surface mount techniques. It is also within the invention for tails formed on base 60 to include a shortened length or stub intended to cooperate with solder balls and the like to electrically connect terminal 54 to an electrical circuit.

It is noted in relation to FIGS. 1-7, that the problem with prior circular power connectors requiring relatively expensive machined parts to accommodate plugs of varying diameter has been overcome. By using a plurality of electrical terminals as described herein, virtually any plug size may be accommodated provided an appropriately sized housing is used.

Figure 8:
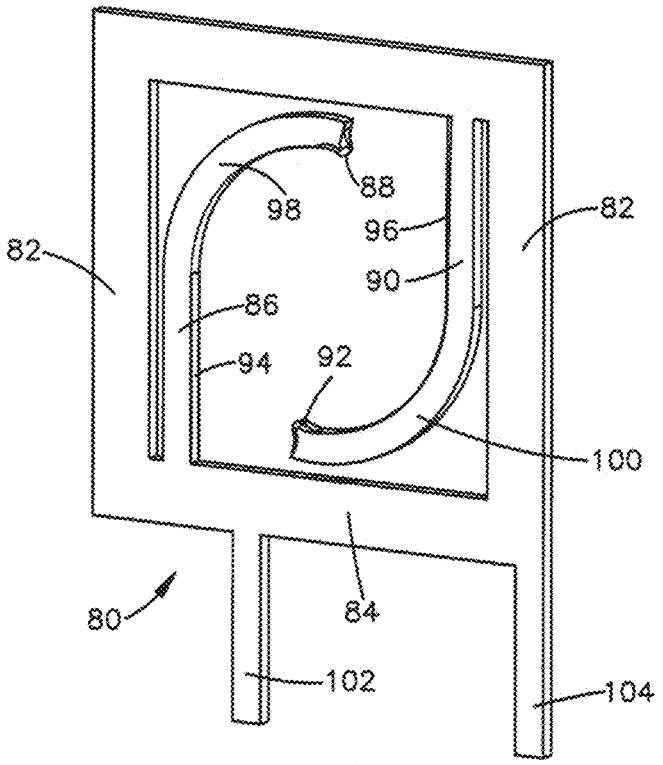
FIG. 8 is an alternate embodiment of the electrical terminal illustrated in FIG. 1.

Referring now to FIG. 8, an alternate electrical terminal 80 is shown. Similar to terminal 20, terminal 80 is an electrically conductive monolithic body. It again should be appreciated, however, unless otherwise indicated, that various components of terminal 80 can be separate from one or more other components of the terminal as desired. Again, it is preferable for terminal 80 to be constructed in a stamping operation. In such an operation sheet metal, which can be stainless steel, tin, copper, alloys including the same, or any alternative suitable electrically conductive material, is stamped to form terminal 80. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

Terminal 80 is shown to include an electrically conductive monolithic body including a generally rectangular frame portion 82 having a base 84 and a first contact beam 86 extending from frame 82 in a first direction and having a contact portion 88. As shown, contact portion 88 includes a projection formed on the end of contact beam 86. It is preferred for contact portion 88 to have a rounded surface. Terminal 80 also includes a second contact beam 90 extending from frame 82 in a second, generally opposite, direction and having a contact portion 92. As shown, contact portion 92 includes a projection formed on the end of contact beam 90. It is preferred for contact portion 92 to have a rounded surface. It is preferred, as shown, for contact beams 86 and 90 to extend from frame 82 to an extent and orientation so that contact portions 88 and 92 are positioned generally opposite one another.

Also as shown in FIG. 8, first and second contact beams 86 and 90 include arm portions 94 and 96. Beams 86 and 90 are formed to include extension portions 98 and 100, respectively. Arm extensions 98 and 100 are shown to be arcuate shaped. It is noted that frame 82 and contact beams 86 and 90 are sized so that the distance between arms 94 and 96 and the distance between contact portions 88 and 92 is sufficient to receive a plug of a desired diameter there between. Although frame 82 is shown to be generally rectangular, it is noted that other configurations are acceptable.

FIG. 8 also shows a pair of tails 102 and 104 extending from base 84 of frame 82. Tails 102 and 104 extend away from base 84. The tails serve to provide an electrical connection between terminal 80 and an electrical circuit. Although tails 102 and 104 are depicted as extending away from base 84 in a direction generally opposite to contact beam 86, the direction of tails 102 and 104 are not so limited. Tails 102 and 104 can have any number of shapes and extend in virtually any direction without departing from the invention. Examples of a few of such embodiments are described below. Indeed, tails 102 and 104 may even include a shortened length or stub intended to cooperate with solder balls and the like to electrically connect terminal 80 to an electrical circuit. It is also noted that while tails 102 and 104 are shown to extend from just one side of frame 82, the invention is not so limited. Tails could extend from multiple sides and either be inserted into a housing or removed before insertion of terminal 80. For instance, tails can be removed from one or more of the sides, such that tails can remain extending from at least one of the sides when the terminal 80 is inserted into the connector housing.

Figure 9:
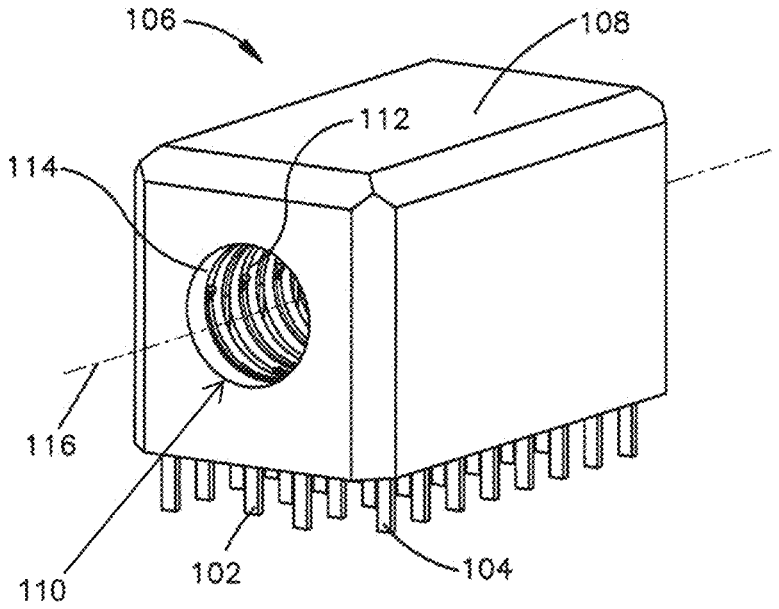
FIG. 9 is a perspective view of a circular power connector incorporating the electrical terminals depicted in FIG. 8.

Referring now to FIG. 9, electrical connector 106 is shown to include a dielectric or electrically insulative connector housing 108 and a plurality of electrical terminals 80 supported by connector housing 108. Housing 108 defines an opening 110 to a receiving chamber 12. Terminals 80 are positioned in housing 108 in relation to receiving chamber 112 so that at least a portion of contact portions 88 and 92 extend into chamber 112. Terminals 80 are positioned in housing 108 through their placement within a series of slots or passages 114 formed in housing 108. Although, slots or passages 114 are depicted, it should be understood that housing 108 could also be formed on terminals 80 by an over-molding operation without departing from the invention. Passages 114 are preferably formed in housing 108 so that terminals 80 are arranged so that contact portions 88 and 92 are arranged cylindrically about insertion axis 116. Passages 114 are sized to allow for the deflection of contact beams 86 and 90 in a direction away from insertion axis 116 during insertion of a plug.

It is noted that terminal 80 as shown in FIG. 8 is preferably inserted into housing 108 in alternating orientations. For example, the one terminal is inserted as oriented in FIG. 8 while the next adjacent terminal is oriented flipped around (mirror image) from the orientation in FIG. 8, i.e., tail 104 would extend along the left most edge of the terminal. Such alternate orientation would extend through housing 108. In still another embodiment, frame 82 would be rotated 90° in each subsequent terminal. Such an arrangement would require tails 102 and 104 to extend from different sides of the frame requiring at least two different terminals to be stamped. However, the resulting connector would include electrical terminals oriented so that the directions along which the contact beams extend in one terminal are at an angle to the contact beams of another electrical terminal in the housing. As depicted in FIG. 9, the angles of the contact beams in subsequent terminals are generally perpendicular to the contact beams of adjacent terminals.

Figure 10:
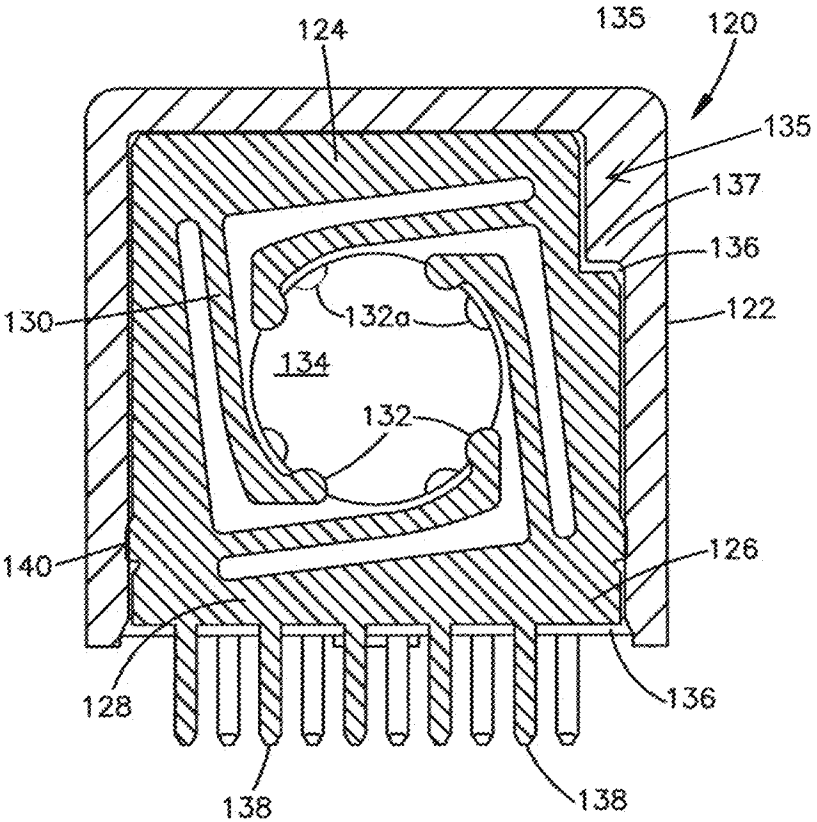
FIG. 10 is a section view of a circular power connector incorporating an alternative electrical terminal than that depicted in FIG. 8.

In relation to the flipped or mirror image arrangement of terminals reference is now made to FIG. 10. Electrical connector 120 is shown to include a dielectric or electrically insulative connector housing 122 and a plurality of electrical terminals 124 supported by connector housing 122. Terminal 124 is shown to include an electrically conductive monolithic body including a generally rectangular frame portion 126 having a base 128 and four contact beams 130 extending from frame 126 in a direction whereby each adjacent contact beam is generally oriented at an angle of 90° to the next adjacent contact beam. In addition, each contact beam 130 extends at an angle to the rectangular frame. Each contact beam 130 includes a contact portion 132. As shown, contact portion 132 includes a projection formed on the end of each contact beam 130. It is preferred for contact portion 132 to have a rounded surface. Housing 122 defines a receiving chamber 134. Terminals 124 are positioned in housing 122 in relation to receiving chamber 134 so that at least a portion of contact portions 132 extend into chamber 134.

Terminals 124 are positioned in housing 322 through their placement within a series of slots or passages formed in the housing. Although, only slot or passage 136 is depicted, it should be understood separate slots for each terminal 124 could be provided. It is also noted that housing 122 could also be formed on terminals 324 by an over-molding operation without departing from the invention. Passage(s) 136 is preferably formed in housing 122 so that terminals 124 are arranged so that contact portions 132 are arranged cylindrically about chamber 134. Passage 136 is sized to allow for the deflection of contact beams 130 in a direction away from an insertion axis passing through the center of chamber 134 during insertion of a plug. Each terminal 124 is preferably provided with a keying gap 135 formed in one corner. A corresponding keying shoulder or projection 137 is formed preferably within each passage 136 formed in housing 122. Thus, the position of the projection 137 can vary along the length of the connector housing. For instance, the position of the projection 137 can alternate between a first location and a second location along the length of the connector housing (i.e., in a direction parallel to the central axis of the receiving chamber.

It is noted that the terminals 124 in connector 120 are preferably inserted into housing 122 in alternating orientations. For example, the first terminal depicted in FIG. 10 is oriented as shown while the next adjacent terminal is oriented flipped around (mirror image) from the first terminal. By alternating the orientation of terminal 124, contact portions 332 are distributed around the circumference of receiving chamber 134. In addition, because contact beams 130 extend from the rectangular frame at an angle, the flip orientation of adjacent terminals results in the contact portions 132 of adjacent terminals being offset with regard to one another. The rectangular frame defines flip axis, and the rectangular frame rotates about the flip axis 180 degrees to define the flip orientation. Further, opposed contact beams 130 are angled so not be mirror images of each other about the flip axis. As shown in FIG. 10, the contact portions 132 of the terminal top terminal are offset from the contact portions 132*a* of the next adjacent terminal. Such offset yields contact portions which are not aligned in relation to the insertion of a plug. As a result a greater number of wear tracks will be present on a given plug ensuring more efficient contact. In order to ensure that each adjacent terminal is inserted in a flipped orientation, keying shoulder 137 should be alternately formed on the opposite side of housing 122 within adjacent passages. FIG. 10 also shows a number of tails 138 extending from base 128 of frame 126. Tails 138 extend away from base 128. The tails serve to provide an electrical connection between terminal 124 and an electrical circuit. It is further noted that tails 138 are offset from the center of base 128. For example, although generally equally spaced, the left most tail is closer to housing 122 than the right most tail. By offsetting the tails in this manner, if adjacent terminals 124 are flipped before insertion, tails 138 of adjacent terminals will be offset from one another. Such offset results in an interstitial pattern more conducive to drill tolerances in circuit board manufacture. Each terminal 124 also includes a toothed surface having one or more teeth 140 to anchor the terminal in housing 122.

Figure 11:
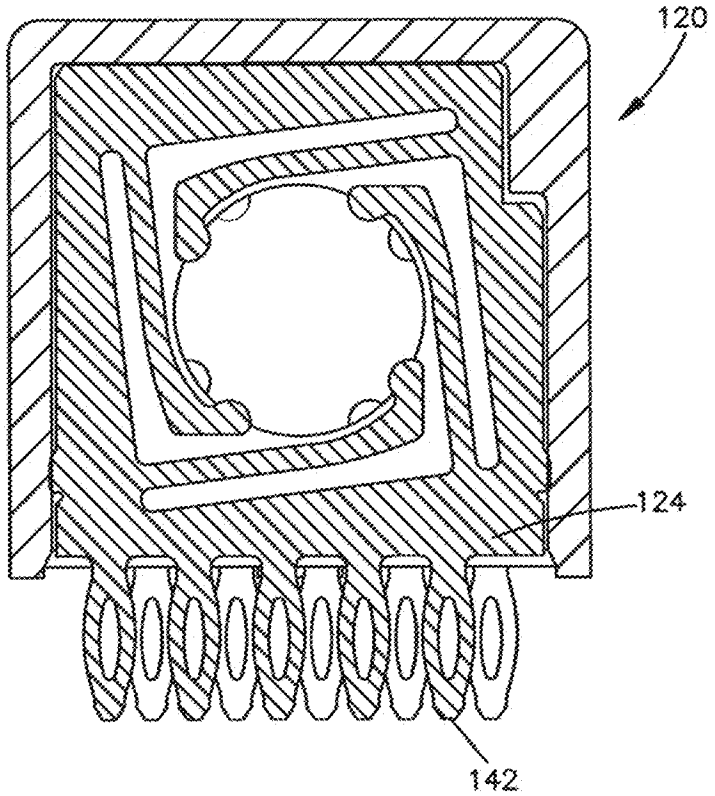
FIG. 11 is a section view perspective view of a circular power connector incorporating an alternative electrical terminal than that depicted in FIG. 8.
Figure 12:
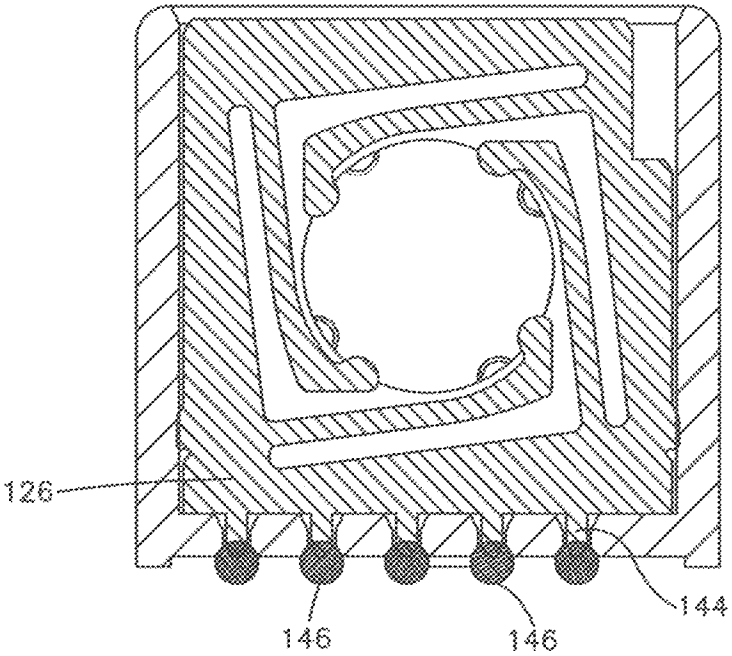
FIG. 12 is a section view perspective view of a circular power connector incorporating an alternative electrical terminal than that depicted in FIG. 8.

In FIG. 11, connector 120 is shown to include terminals 124 having tails that are formed as press fit tails 142. As shown in FIG. 12, it is also within the invention for tails formed on base 124 to include a shortened length tail or stub 344 and associated solder balls 146 attached thereto by any conventional means to electrically connect terminal 126 to an electrical circuit.

Figure 13:
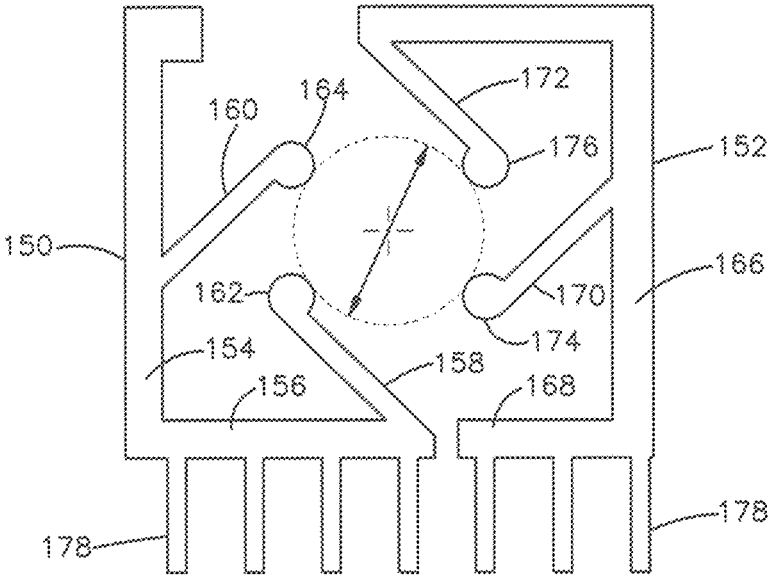
FIG. 13 is an alternate embodiment of the electrical terminal illustrated in FIG. 1.

A still further embodiment of the invention is shown in FIG. 13 in which complementary electric terminals 350 and 152 are depicted. Similar to other terminal embodiments described herein, terminals 150 and 152 are electrically conductive monolithic bodies. It again should be appreciated, however, unless otherwise indicated, that various components of terminals 150 and 352 can be separate from one or more other components as desired. Again, it is preferable for terminals 150 and 152 to be constructed in a stamping operation. In such an operation sheet metal, which can be stainless steel, tin, copper, alloys including the same, or any alternative suitable electrically conductive material, is stamped to form the terminals. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

Terminal 150 is shown to include an electrically conductive monolithic body including a partial rectangular frame portion 154 having a base 156 and a first contact beam 158 extending from frame 154 in a first direction, and a second contact beam 160 extending from frame 154 in a second direction. As shown, the first and second directions are generally perpendicular to one another. Each contact beam 158 and 160 includes a rounded contact portion 162 and 164, respectively. It is preferred for contact portions 162 and 164 to have rounded surfaces.

Terminal 152 also includes a partial rectangular frame portion 166 having a base 168 and a first contact beam 170 extending from frame 166 in a first direction, and a second contact beam 172 extending from frame 166 in a second direction. As shown, the first and second directions are generally perpendicular to one another. Each contact beam 170 and 172 includes a rounded contact portion 174 and 176, respectively. It is preferred for contact portions 174 and 176 to have rounded surfaces.

FIG. 13 also shows a number of tails 178 extending from base 156 and 168 of frames 154 and 166. Tails 178 extend away from the frames. The tails serve to provide an electrical connection between the terminals and an electrical circuit. Although tails 178 are depicted as extending away from frames 154 and 166, the direction of the tails is not so limited.

Figure 14:
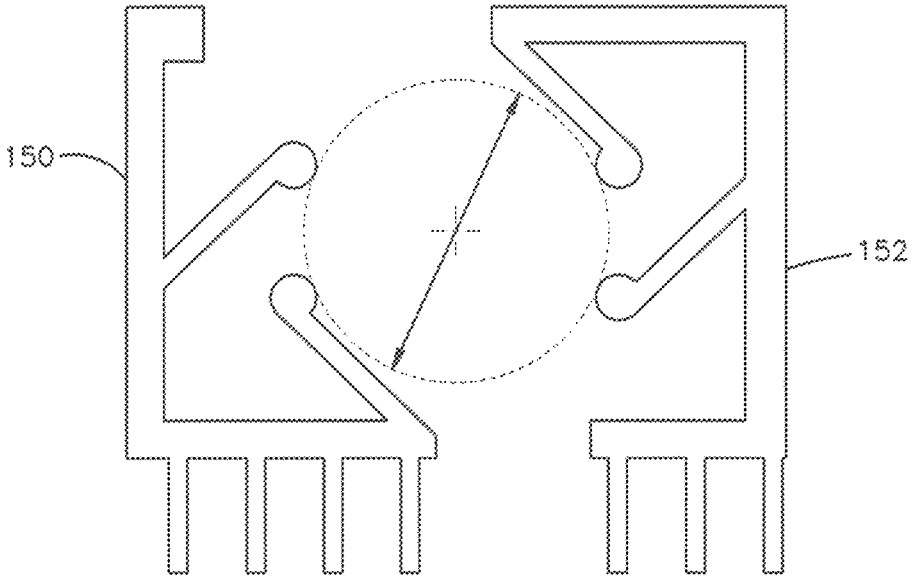
FIG. 14 shows the connectors of FIG. 13 spaced apart.

In addition to being susceptible to be generated via stamping operations, another benefit of terminals 150 and 152 is they can be made to accommodate plugs of varying sizes simply by increasing or decreasing the spacing between them. For example, as depicted in FIG. 13, terminals 150 and 152 are spaced to accommodate a plug of a given size. As shown in FIG. 14, terminals 150 and 152 can accommodate a larger plug simply by increasing the spacing between the terminals.

Figure 15:
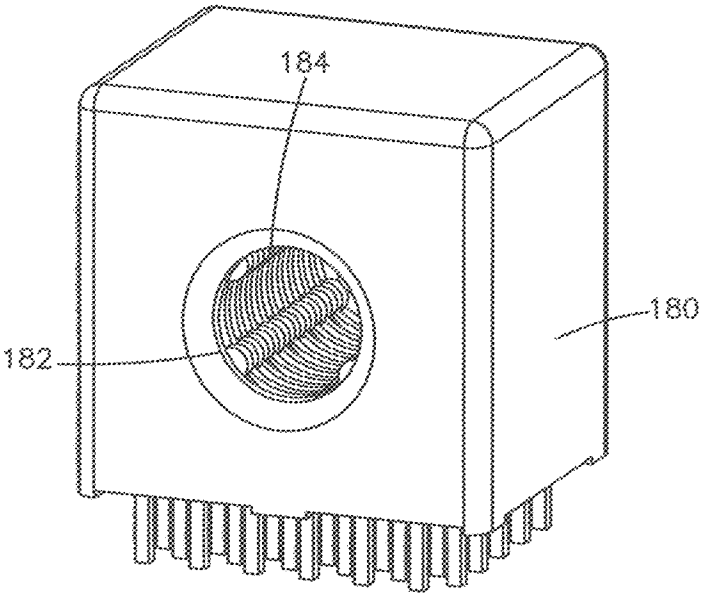
FIG. 15 is a perspective view of a circular power connector incorporating the electrical terminals depicted and as spaced as shown in FIG. 13.

A more specific embodiment is depicted in FIG. 15. As shown, terminals 150 and 152 are positioned within housing 180. Housing 180 is a dielectric or electrically insulative connector housing. Housing 180 defines an opening 182 to a receiving chamber 184. Terminals 150 and 152 are positioned in housing 180 in relation to receiving chamber 184 so that at least a portion of contact portions 162, 164, 174 and 176 extend into chamber 184. Terminals 150 and 152 are positioned in housing 180 through their placement within a series of slots or passages formed in housing 180. Although, slots or passages are depicted, it should be understood that housing 180 could also be formed on terminals 150 and 152 by an over-molding operation without departing from the invention. The width of the passages formed in housing 180 is such that terminals 150 and 152 can be spaced sufficiently so that contact portions 162, 164, 174 and 176 extend into chamber 184 and arranged cylindrically about chamber 184. The passages are also sized to allow for the deflection of contact beams 158, 160, 170 and 372 in a direction away from the central insertion axis of chamber 184 during insertion of a plug. In order to accommodate a larger plug, a larger housing having passages permitting greater spacing of terminals 150 and 152 is needed.

Figure 16:
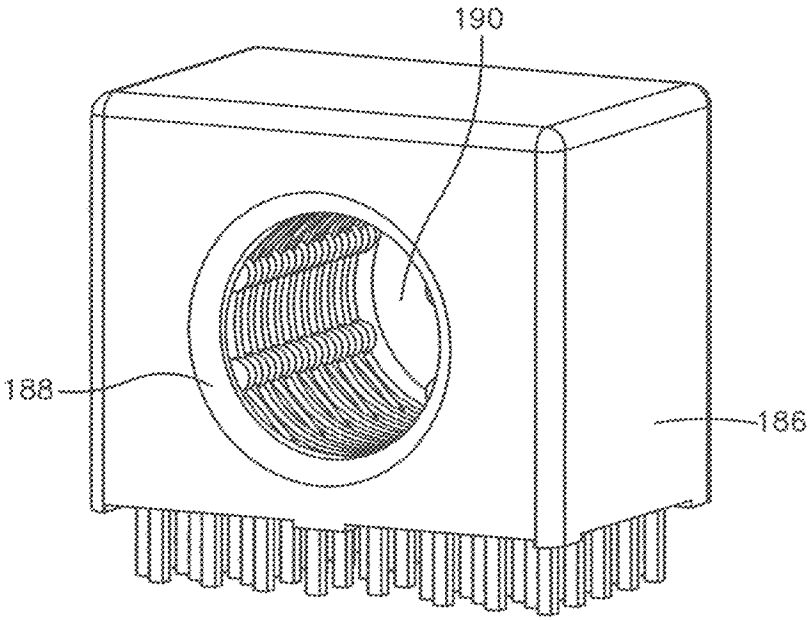
FIG. 16 is a perspective view of a circular power connector incorporating the electrical terminals depicted and as spaced as shown in FIG. 14.

Referring to FIG. 16, a larger dielectric or electrically insulative connector housing 186 is provided. Again, terminals 150 and 152 are positioned within housing 186. Housing 186 defines an opening 188 to a receiving chamber 190. Terminals 150 and 152 are positioned in housing 186 in relation to receiving chamber 190 so that at least a portion of contact portions 162, 364, 174 and 176 extend into chamber 390. Terminals 150 and 152 are again positioned in housing 186 through their placement within a series of slots or passages formed in housing 386. Although, slots or passages are depicted, it should be understood that housing 186 could also be formed on terminals 150 and 152 by an over-molding operation without departing from the invention. The width of the passages formed in housing 186 is again such that terminals 150 and 152 can be spaced sufficiently so that contact portions 162, 164, 174 and 176 extend into chamber 190 and arranged cylindrically about chamber 190. The passages are also sized to allow for the deflection of contact beams 158, 160, 170 and 172 in a direction away from the central insertion axis of chamber 190 during insertion of a plug. In order to accommodate the larger plug, housing 186 includes passages permitting greater spacing of terminals 150 and 152 than could be achieved in housing 180.

It may be appreciated from the above explanations that a method for receiving a plug connector includes a step of providing an electrical housing defining a receptacle chamber and an opening to the chamber, wherein the opening and the chamber sufficiently sized to receive the plug connector. The method also includes a step of providing a plurality of electrical terminals wherein each terminal includes an electrically conductive monolithic body having a frame portion, a first contact beam extending from the frame portion in a first direction, and a second contact beam extending from the frame in a second direction, where the first and second contact beams include contact portions. The method also includes the step of positioning the electric terminals in the housing in relation to the receiving chamber so that the contact portions of at least one of the electrical terminals extends into one side of the chamber and further so that the contact portions of at least one other electrical terminal extends into the chamber on a different side different from the contact portions of the at least one electrical terminal.

Still further, a method for constructing receptacle connectors to receive plug connectors of various sizes includes the steps of providing first and second electrical housings where the first housing defines a receptacle chamber of a first size and an opening to said chamber, wherein the opening and the chamber are of sufficient size to receive at least one of the plug connectors and wherein the second housing defines a receptacle chamber of a second size and an opening to said chamber, wherein the opening and the chamber are of sufficient size to receive another plug connector having a different size. The method also includes the step of providing a plurality of electrical terminals wherein each terminals includes an electrically conductive monolithic body including a frame portion, a first contact beam extending from the frame portion in a first direction, and a second contact beam extending from the frame in a second direction, where the first and second contact beams include contact portions. The method also includes the step of positioning the electric terminals in the first housing in relation to the receiving chamber so that the contact portions of at least one of the electrical terminals extends into one side of the chamber and further so that the contact portions of at least one other of the electrical terminals extends into the chamber on a side different from the contact portions of the at least one electrical terminal and positioning the electric terminals in the second housing in relation to the receiving chamber so that the contact portions of at least one of the electrical terminals extend into one side of the chamber and further so that the contact portions of at least one other of the electrical terminals extend into the chamber on a side different from the contact portions of the at least one electrical terminal, wherein the electric terminals positioned in the second housing are spaced further apart than the electric terminals positioned in the first housing.

Figure 17:
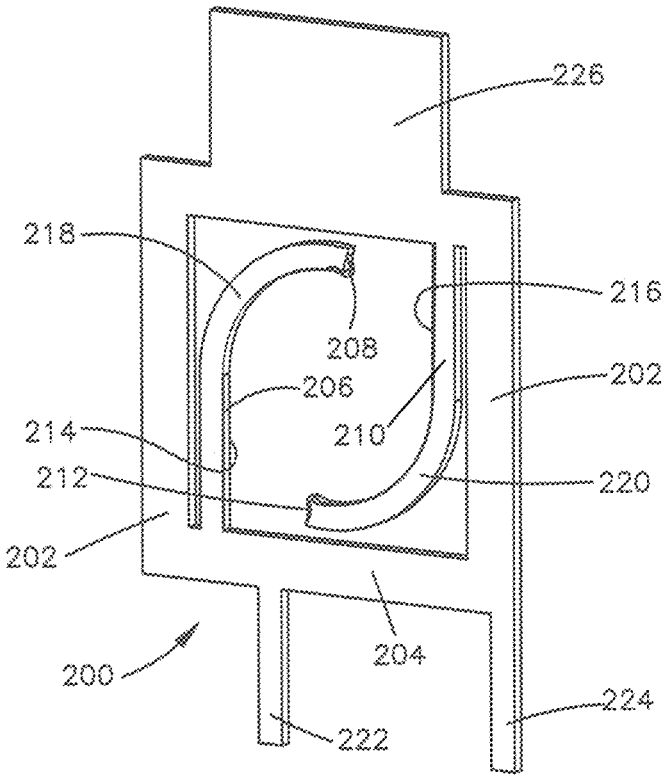
FIG. 17 is an alternate embodiment of the electrical terminal illustrated in FIG. 1.

Referring now to FIG. 17, a further alternate electrical terminal 200 is shown. Similar to terminals 20 and 80, terminal 200 is an electrically conductive monolithic body. It again should be appreciated, however, unless otherwise indicated, that various components of terminal 200 can be separate from one or more other components of the terminal as desired. Again, it is preferable for terminal 200 to be constructed in a stamping operation. In such an operation sheet metal, which can be stainless steel, tin, copper, alloys including the same, or any alternative suitable electrically conductive material, is stamped to form terminal 200. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

Terminal 200 includes a generally rectangular frame portion 202 having a base 204 and a first contact beam 206 extending from frame 202 in a first direction and having a contact portion 208. As shown, contact portion 208 includes a projection formed on the end of contact beam 206. It is preferred for contact portion 208 to have a rounded surface. Terminal 200 also includes a second contact beam 210 extending from frame 202 in a second, generally opposite, direction. It is preferred, as shown, for contact beams 206 and 210 to extend from frame 202 to an extent and orientation so that contact portions 208 and 212 are positioned generally opposite one another.

Also as shown in FIG. 17, first and second contact beams 206 and 210 include arm portions 214 and 216. Beams 206 and 210 are formed to include extension portions 238 and 220, respectively. Arm extensions 218 and 220 are shown to be arcuate shaped. It is noted that frame 202 and contact beams 206 and 210 are sized so that the distance between arms 214 and 216 and the distance between contact portions 208 and 212 is sufficient to receive a plug of a desired diameter there between. Although frame 202 is shown to be generally rectangular, it is noted that other configurations are acceptable.

FIG. 17 also shows a pair of tails 222 and 224 extending from base 204 of frame 202. Tails 222 and 224 extend away from base 204. The tails serve to provide an electrical connection between terminal 200 and an electrical circuit. Although tails 222 and 224 are depicted as extending away from base 204 in a direction generally opposite to contact beam 206, the direction of tails 222 and 224 are not so limited. Tails 222 and 224 can have any number of shapes and extend in virtually any direction without departing from the invention. Examples of a few of such embodiments are described above. It is also noted that while tails 222 and 224 are shown to extend from just one side of frame 202, the invention is not so limited. Tails could extend from multiple sides and either be inserted into a housing or removed before insertion of terminal 200. For instance, tails can be removed from one or more of the sides, such that tails can remain extending from at least one of the sides when the terminal 200 is inserted into the connector housing.

FIG. 17 also shows a thermally conductive extension member 226 extending from frame 202 and thermally coupled to frame 202. It is preferred for extension 226 to be monolithic with frame 202. In such embodiments, member 226 acts as a heat sink conducting heat away from or towards frame 202 and its components.

Figure 18:
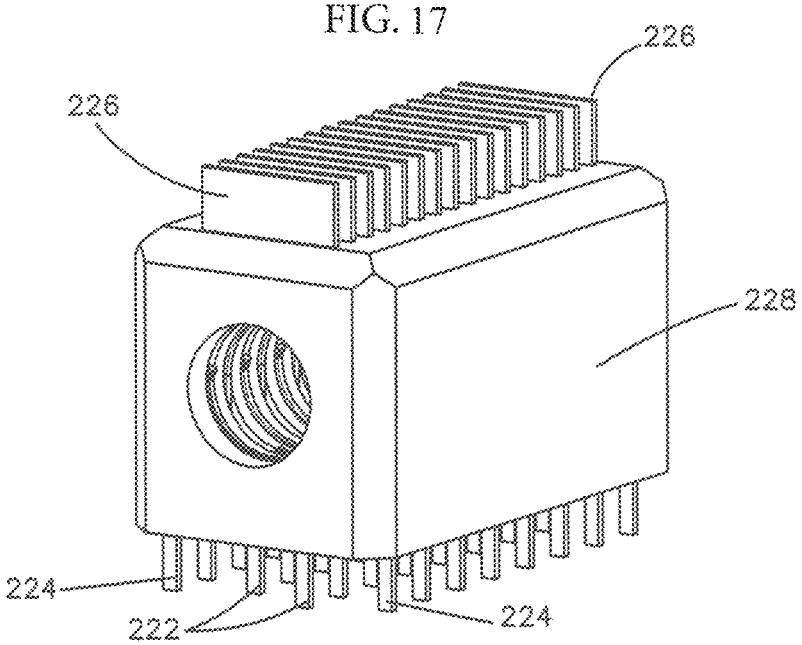
FIG. 18 is a perspective view of a circular power connector incorporating the electrical terminals depicted in FIG. 17.
Figure 19:
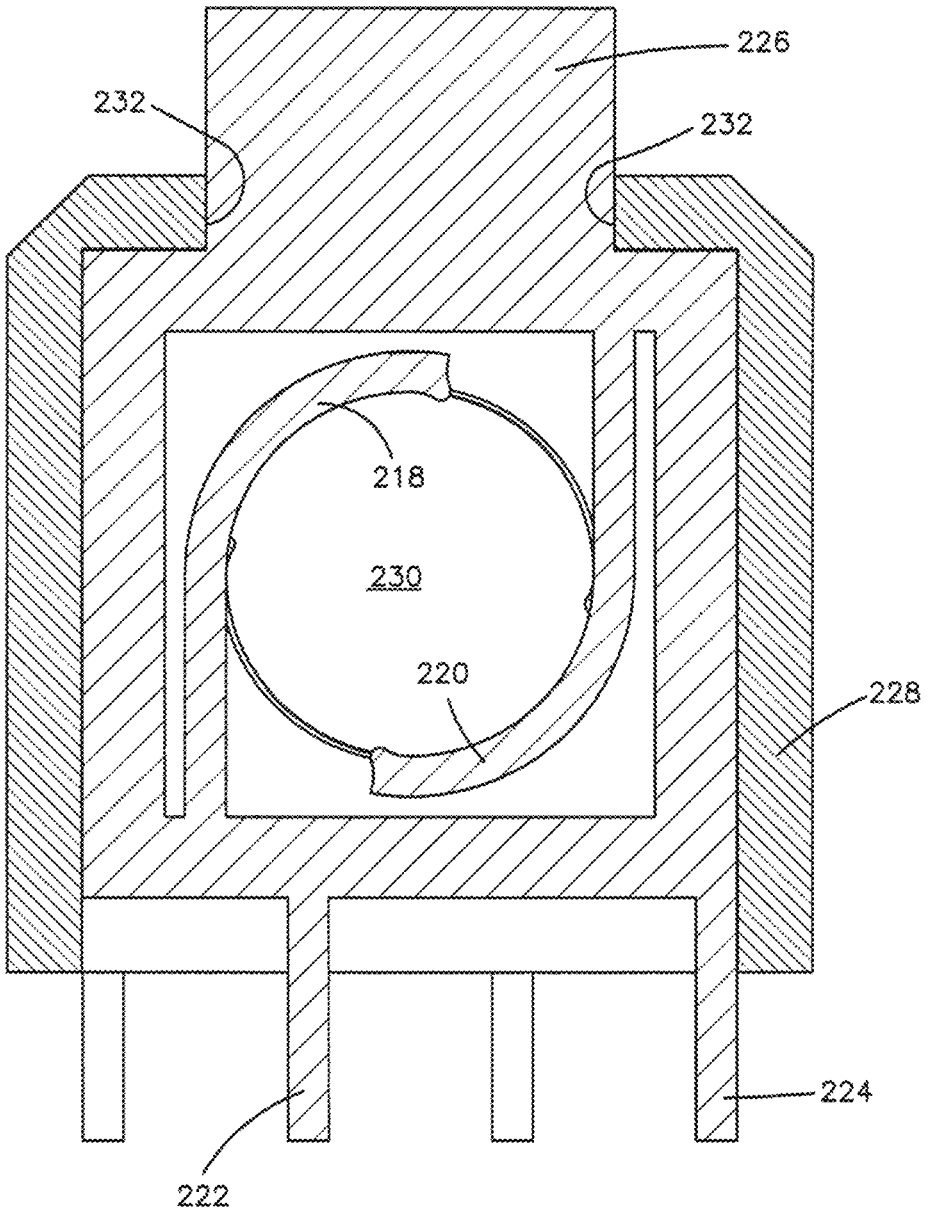
FIG. 19 is a section view of a circular power connector incorporating the electrical terminal depicted in FIG. 17.
Figure 20:
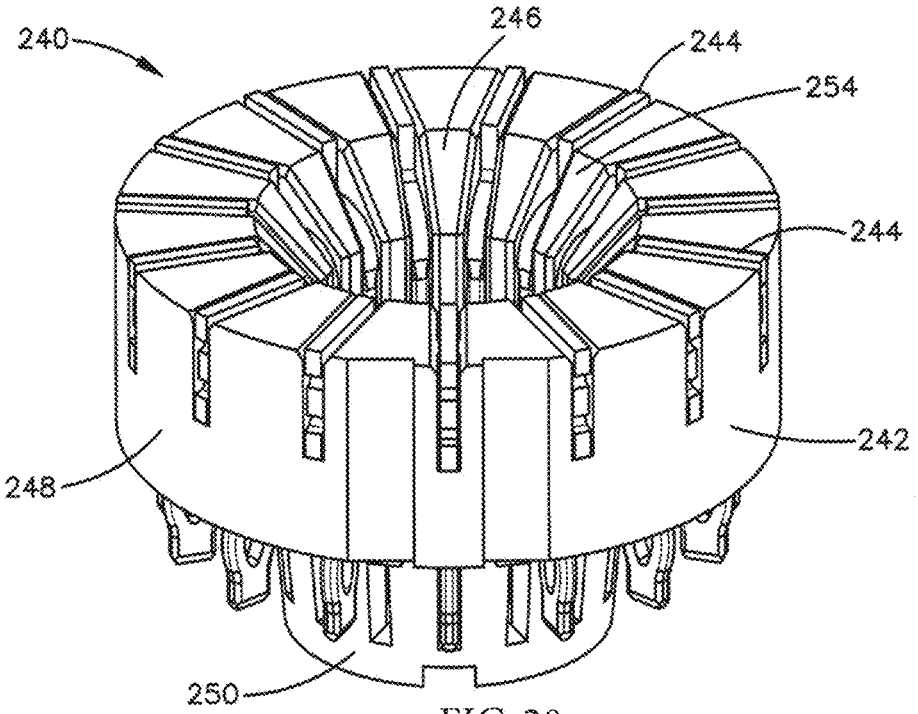
FIG. 20 is a perspective view of an alternate embodiment of a circular power connector incorporating an alternative electrical terminal than that depicted in FIG. 3.
Figure 21:
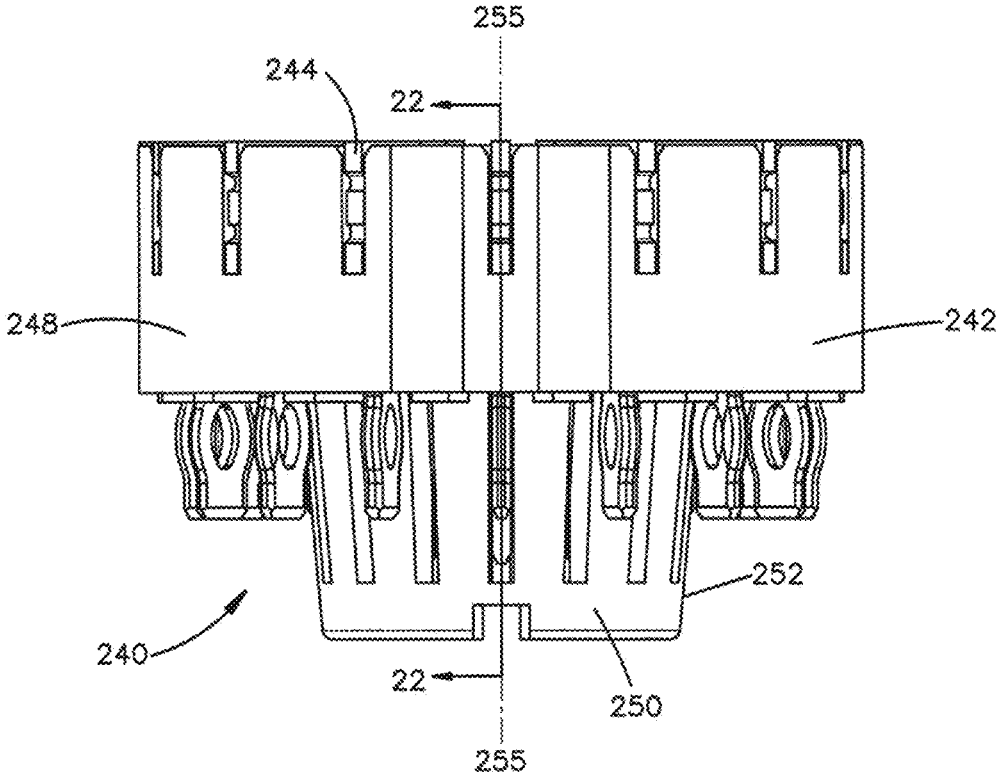
FIG. 21 is a plan view of the circular power connector depicted in FIG. 20.
Figure 22:
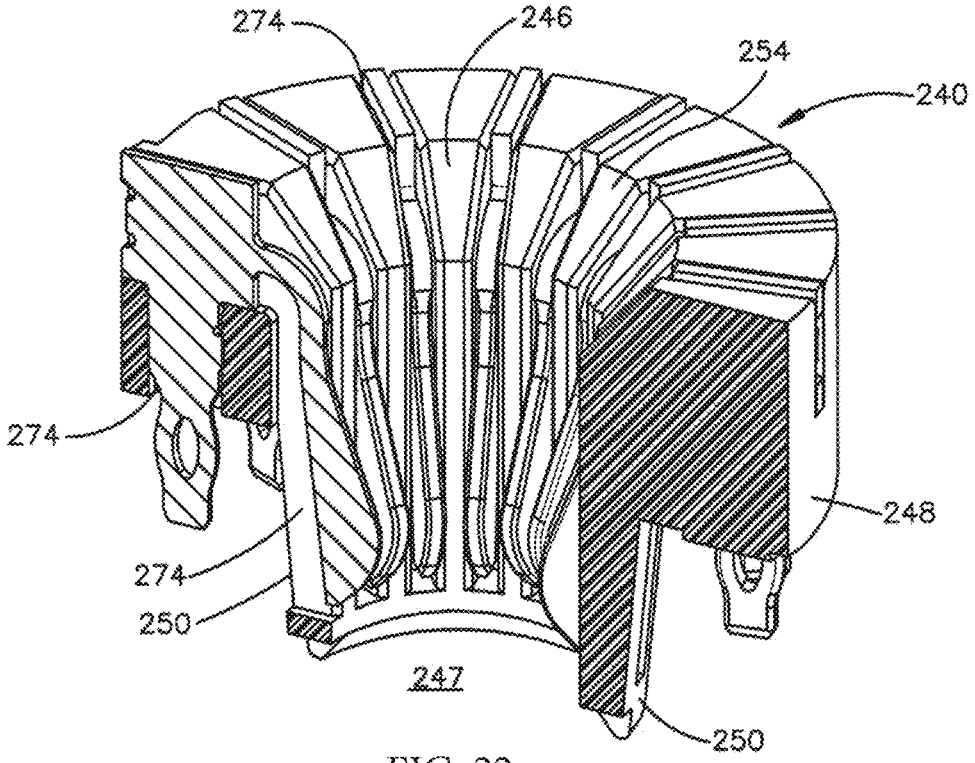
FIG. 22 is a perspective section view taken along the tine 22-22 in FIG. 21.
Figure 23:
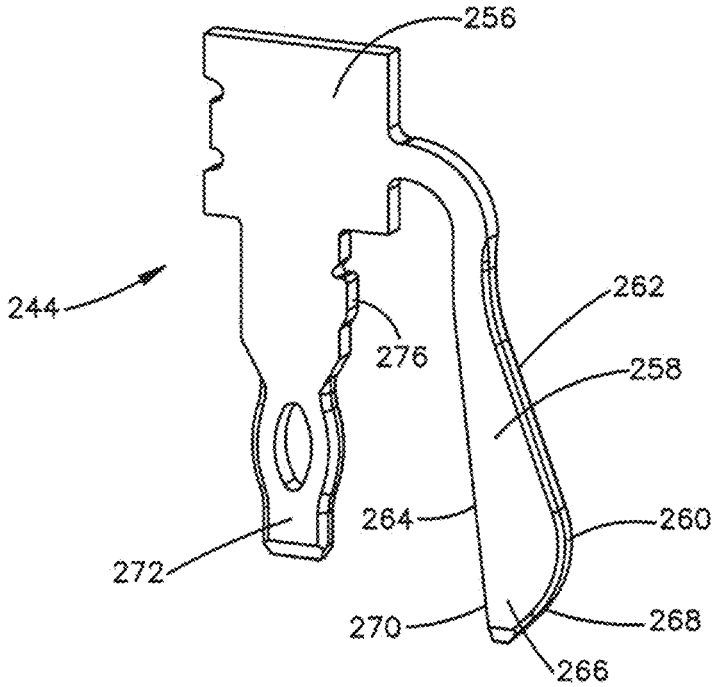
FIG. 23 is a perspective view of an electrical terminal depicted in FIG. 22 and constructed in accordance with another embodiment.

Referring now to FIG. 38 an electrical connector is shown to include a dielectric or electrically insulative connector housing 228 and a plurality of electrical terminals 200 supported by connector housing 228. Housing 228 defines an opening to a receiving chamber 230 (FIG. 19). Terminals 200 are positioned in housing 228 in relation to the receiving chamber so that at least a portion of contact portions 208 and 212 extend into the chamber. Terminals 200 are positioned in housing 228 through their placement within a series of slots or passages 232 formed in housing 228 as shown in FIG. 19. Although, slots or passages 232 are depicted, it should be understood that housing 228 could also be formed on terminals 200 by an over-molding operation without departing from the invention. Passages 232 are preferably formed in housing 228 so that terminals 200 are arranged so that contact portions 208 and 212 are arranged cylindrically about an insertion axis. As also shown in FIGS. 18 and 19, extension members 226 extend through and beyond housing 228 and in this way can be exposed to ambient, air or gas to assist in the dissipation or insertion of heat from or into terminals 200.

Similar to the terminals depicted in FIG. 8, it is noted that terminal 200 is preferably inserted into housing 228 in alternating orientations. For example, the one terminal is inserted as oriented in FIG. 19 while the next adjacent terminal is oriented flipped around (mirror image) from the orientation in FIG. 19. Such alternate orientation would extend through housing 228.

Referring now to FIGS. 20-23 an electrical connector 240 is shown to include a dielectric or electrically insulative connector housing 242 having a generally cylindrical shape and a plurality of electrical terminals 244 supported by connector housing 242. Housing 242 defines an opening 246 to a receiving chamber 247. The diameter of opening 246 is preferably sized to permit passage of a power plug into chamber 247. Housing 242 includes a generally cylindrical base portion 248 and a generally cylindrical central portion 250 extending from base portion 248. Base portion 248 and central portion 250 together define chamber 247. Although portions 248 and 250 are shown to be monolithic, it should be appreciated, unless otherwise indicated, that such components can be separate from one another. Central portion 250 includes a frustoconical outer surface 252 where the outer surface diameter of portion 250 becomes smaller along the length of portion 250 extending away from base portion 248.

Housing 242 is also shown to define an angled surface 254 surrounding opening 246. Surface 254 also acts to locate and center a plug being inserted into connector 240. Opening 246, the receiving chamber and angled surface 254 preferably are centered about an insertion axis 255.

Referring again to FIG. 23, a single electrical power terminal 244 is shown. Terminal 244 is an electrically conductive monolithic body. It should be appreciated, however, unless otherwise indicated, that various components of the terminal 244 can be separate from one or more other components of the terminal as desired. Preferably, the terminal 244 is constructed in a stamping operation. In such an operation sheet metal, which can be stainless steel, tin, copper, alloys including the same, or any alternative suitable electrically conductive material, is stamped to form the terminal 24. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

The power terminal 244 can include a base 256 and a contact beam 258 that extends from the base 256. Base 256 and contact beam 258 can be monolithic with each other. The contact beam 258 defines a contact portion 260 that is configured to contact a complementary electrical power terminal that is mated with the power terminal 244. The complementary power terminal can be supported by a plug housing of a plug connector that is received by a receptacle connector that includes the power terminal 244. The contact portion 260 includes a first side 262 and a second side 264. The first side 262 can be referred to as a first contact side, and the second side 264 can be referred to as a second contact side. The first side 262 can be opposite the second side 264. For instance, the first side 262 can be spaced radially inward with respect to the second side 264 when the power terminal 244 is supported by connector housing 242. The first and second sides 262 and 264 can further be oriented at an angle relative to each other. For instance, the first side 262 can angled with respect to the second side 264. In one example, the first side 262 can be angled relative to the second side 264 such that the width of terminal 244 or the distance from the first side 262 to the second side 264 becomes greater in a direction away from base 256. Otherwise stated, the first side 262 can flare away from the second side 264 as it extends in a direction away from the base 256.

The contact beam 258 can further include an insertion portion 266 disposed at the end of power terminal 244 furthest from base 256. Thus, the contact portion 260 can be disposed between the base 256 and the insertion portion 266. The insertion portion 266 can define a first side 268 and a second side 270. The first side 268 can be referred to as a first insertion side, and the second side 270 can be referred to as a second insertion side. The first side 268 can be opposite the second side 270. For instance, the first side 268 can be spaced radially inward with respect to the second side 270 when the power terminal is supported by the connector housing 242. The first and second sides 268 and 270 can further be oriented at an angle relative to each other. In one example, the first side 268 can be angled relative to the second side 270 such that the width of terminal 244 or the distance from the first side 268 to the second side 270 becomes smaller along the insertion portion 266 in a direction away from base 256. It should thus be appreciated that the first side 262 of the contact portion 260 and the first side 268 of the insertion portion 266 join together at an interface that can be defined by an apex of the contact beam 258.

In FIGS. 20-23, connector 240 is shown to include terminals 244 having tails 272 that are formed as press fit tails and which extend from base 256 in generally the same direction as contact beams 258, Tails 272 extend from base portion 248 in generality the same direction as beams 258. It is noted that each terminal 244 is positioned within one of a plurality of slots 274 formed in housing 242. Although terminals 244 can be held within slots 274 in any number of ways, the terminals are shown a toothed surface having one or more teeth 276 for engaging an inner wall within base portion 248 of slot 274 and holding terminal 244 in place. It is noted that in order to allow beams 258 to flex upon insertion of a plug into cavity 247, the width of slot 274 within central portion 250 permits the movement of beam 258 within the slot. Although, slots or passages 274 are depicted, it should be understood that housing 242 could also be formed on terminals 244 by an over-molding operation without departing from the invention.

Figure 24:
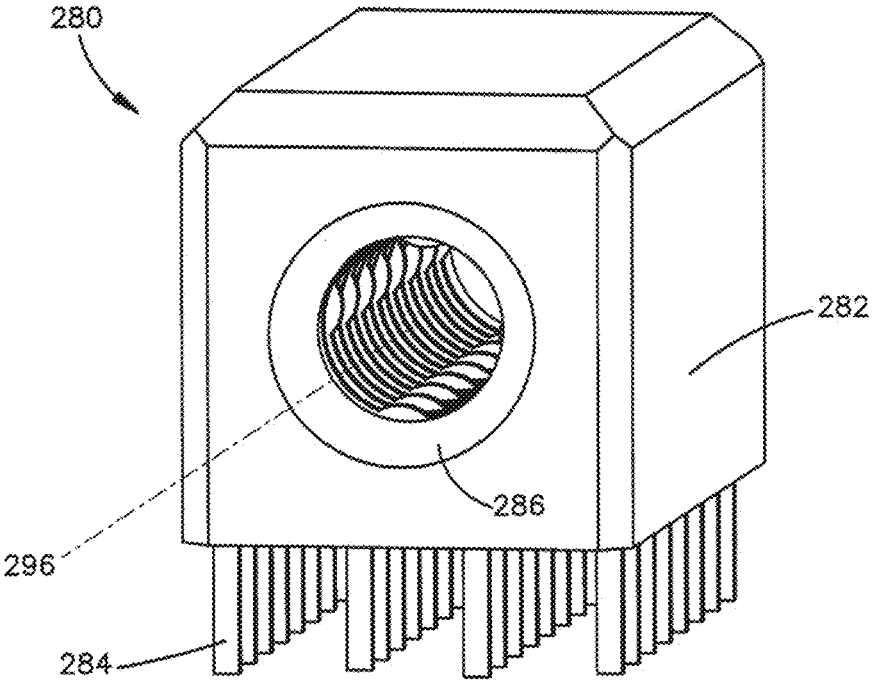
FIG. 24 is a perspective view of an alternate embodiment of a circular power connector to that depicted in FIG. 9.
Figure 25:
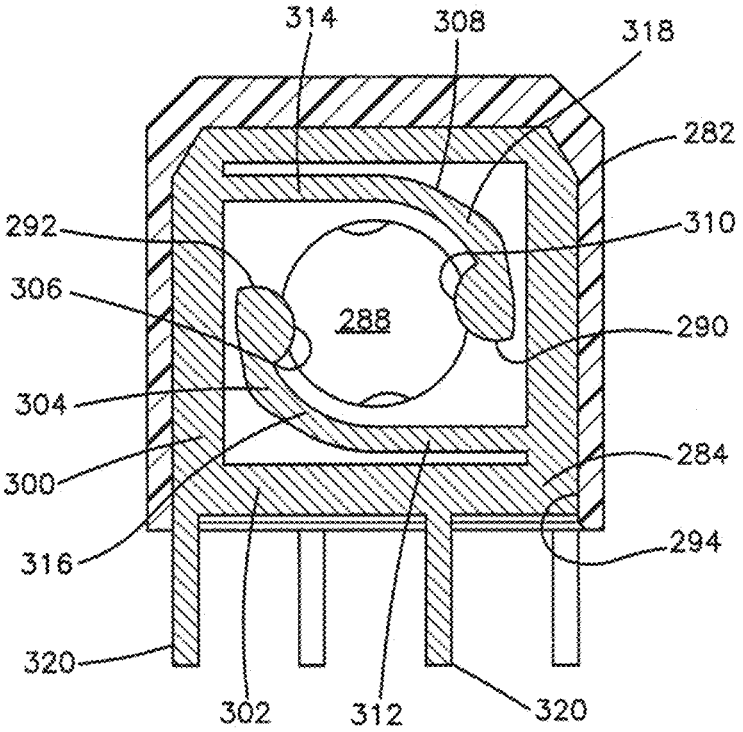
FIG. 25 is a section view of a circular power connector depicted in FIG. 24.
Figure 26:
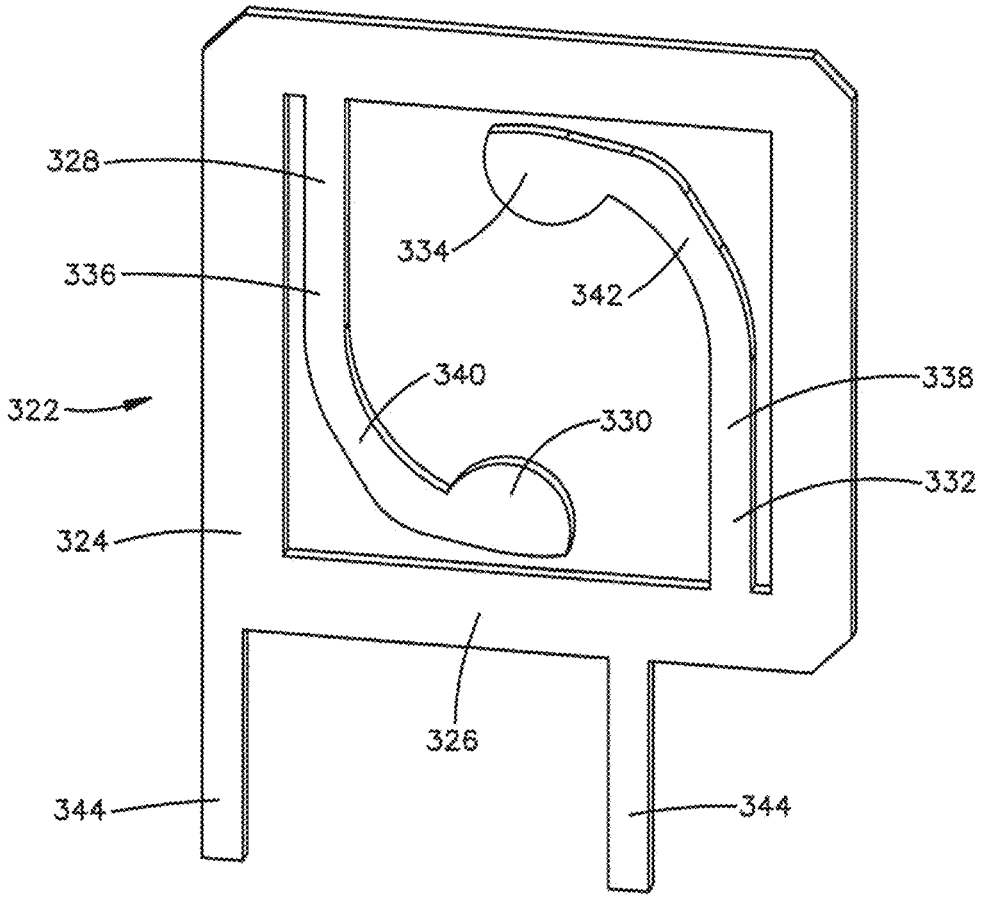
FIG. 26 is a perspective view of an electrical terminal depicted in FIG. 25 and constructed in accordance with another embodiment.

Referring now to FIGS. 24-26, electrical connector 280 is shown to include a dielectric or electrically insulative connector housing 282 and a plurality of electrical terminals 284 supported by connector housing 282. Housing 282 defines an opening 286 to a receiving chamber 288. Terminals 284 are positioned in housing 282 in relation to receiving chamber 288 so that at least a portion of contact portions 290 and 292 extend into chamber 288. Terminals 284 are positioned in housing 282 through their placement within a series of slots or passages 294 formed in housing 282. Although, slots or passages 294 are depicted, it should be understood that housing 282 could also be formed on terminals 284 by an over-molding operation without departing from the invention. Passages 294 are preferably formed in housing 282 so that terminals 284 are arranged so that contact portions 290 and 292 are arranged cylindrically about insertion axis 296. Passages 294 are sized to allow for the deflection of contact beams 290 and 292 in a direction away from insertion axis 296 during insertion of a plug.

An alternate terminal 322 is depicted in FIG. 26. Terminals 284 and 322 are preferably each an electrically conductive monolithic body. It again should be appreciated, however, unless otherwise indicated, that various components of terminals 284 and 322 can be separate from one or more other components of the terminal as desired. Again, it is preferable for terminals 284 and 322 to be constructed in a stamping operation. In such an operation sheet metal, which can be stainless steel, tin, copper, alloys including the same, or any alternative suitable electrically conductive material, is stamped to form the terminals. In one example, a plurality of terminals is formed from a single sheet of material and is supported by a common carrier strip. Thus, the stamped electrical terminals and the carrier strip can be monolithic with each other. The electrical terminals can be separated from the carrier strip in the usual manner.

Referring to FIG. 25, terminal 284 is shown to include an electrically conductive monolithic body including a generally rectangular frame portion 300 having a base 302 and a first contact beam 304 extending from frame 300 in a first direction and having a contact portion 306. As shown, contact portion 306 is a rounded projection formed on the end of contact beam 304. Terminal 284 also includes a second contact beam 308 extending from frame 300 in a second, generally opposite, direction and having a contact portion 310. As shown, contact portion 310 is a rounded projection formed on the end of contact beam 308. It is preferred, as shown, for contact beams 304 and 308 to extend from frame 300 to an extent and orientation so that contact portions 306 and 310 are positioned generally opposite one another.

Also as shown in FIG. 25, first and second contact beams 304 and 308 include arm portions 312 and 314. Beams 304 and 308 are formed to include extension portions 316 and 318, respectively. It is noted that frame 300 and contact beams 304 and 308 are sized so that the distance between arms 314 and 312 and the distance between contact portions 306 and 310 is sufficient to receive a plug of a desired diameter there between. Although frame 300 is shown to be generally rectangular, it is noted that other configurations are acceptable.

FIG. 25 also shows a pair of tails 320 extending from base 302 of frame 300. Tails 320 extend away from base 302. The tails serve to provide an electrical connection between terminal 284 and an electrical circuit. Although tails 320 are depicted as extending away from base 302, the direction is not so limited. Tails 320 can have any number of shapes and extend in virtually any direction without departing from the invention. Indeed, tails 320 may even include a shortened length or stub intended to cooperate with solder balls and the like to electrically connect terminal 284 to an electrical circuit. It is also noted that while tails 320 are shown to extend from just one side of frame 300, the invention is not so limited. Tails could extend from multiple sides and be either inserted into a housing or removed before insertion of terminal 284. For instance, tails can be removed from one or more of the sides, such that tails can remain extending from at least one of the sides when the terminal 284 is inserted into the connector housing.

It is noted that terminal 284 can be inserted into housing 282 in alternating orientations. For example, the one terminal is inserted as oriented in FIG. 25 while the next adjacent terminal is oriented flipped around (mirror image) from the orientation in FIG. 25 i.e., tail 320 would extend along the right most edge of the terminal. Such alternate orientation would extend through housing 282.

In still another embodiment, frame 300 could be rotated 90° resulting in terminal 322, shown in FIG. 26. Terminal 322 is shown to include an electrically conductive monolithic body including a generally rectangular frame portion 324 having a base 326 and a first contact beam 328 extending from frame 324 in a first direction and having a first contact portion 330. As shown, contact portion 330 is a rounded projection formed on the end of contact beam 328. Terminal 322 also includes a second contact beam 332 extending from frame 324 in a second, generally opposite, direction and having a second contact portion 334. As shown, contact portion 334 is a rounded projection formed on the end of contact beam 332. It is preferred, as shown, for contact beams 328 and 332 to extend from frame 324 to an extent and orientation so that contact portions 330 and 334 are positioned generally opposite one another.

Also as shown in FIG. 26, first and second contact beams 328 and 332 include arm portions 336 and 338. Beams 328 and 332 are formed to include extension portions 340 and 342, respectively. It is noted that frame 324 and contact beams 328 and 332 are sized so that the distance between arms 336 and 338 and the distance between contact portions 330 and 334 is sufficient to receive a plug of a desired diameter there between. Although frame 324 is shown to be generally rectangular, it is noted that other configurations are acceptable.

Terminal 322 also includes a pair of tails 344 extending from base 326 of frame 324. Tails 344 extend away from base 326. The tails serve to provide an electrical connection between terminal 322 and an electrical circuit. Although tails 344 are depicted as extending away from base 326, the direction is not so limited. Tails 344 can have any number of shapes and extend in virtually any direction without departing from the invention. Indeed, tails 344 may even include a shortened length or stub intended to cooperate with solder bails and the like to electrically connect terminal 322 to an electrical circuit. It is also noted that while tails 344 extend from just one side of frame 324, the invention is not so limited. Tails 344 could extend from multiple sides and be either inserted into a housing or removed before insertion of terminal 322. For instance, tails can be removed from one or more of the sides, such that tails can remain extending from at least one of the sides when the terminal 322 is inserted into the connector housing.

Again, referring to FIG. 25, it is preferred to alternate inserting terminal 284 and terminal 322, as subsequent terminals in housing 282. Such an arrangement would require tails to extend from different sides of the frame requiring at least two different terminals to be stamped. However, the resulting connector would include electrical terminals oriented so that the directions along which the contact beams extend in one terminal are at an angle to the contact beams of another electrical terminal in the housing. As depicted in FIGS. 24 and 25, the angles of the contact beams in subsequent terminals are generally perpendicular to the contact beams of adjacent terminals.

Figure 27:
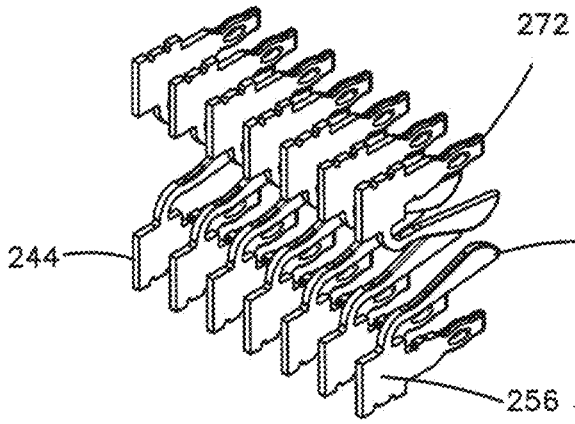
FIG. 27 is a perspective view of a number of pairs of the electrical terminal depicted in FIG. 23.
Figure 28:
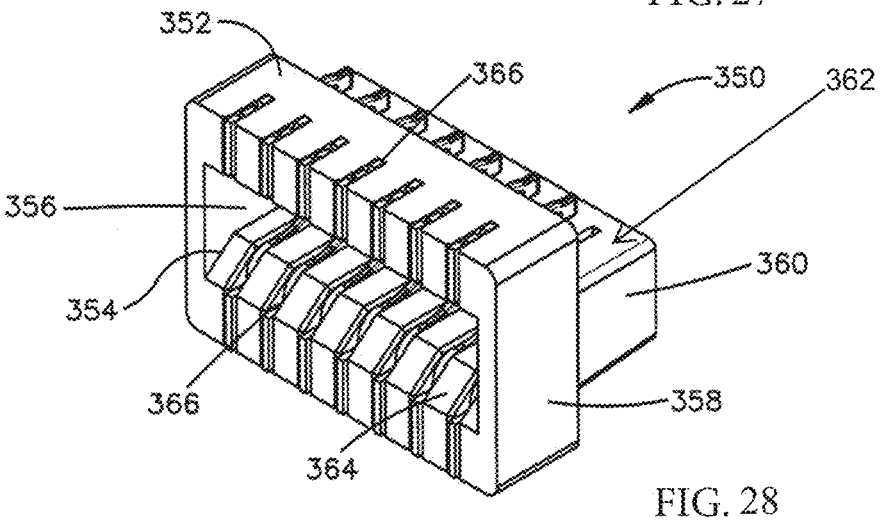
FIG. 28 is a perspective view of an alternate embodiment of an electrical connector incorporating the electrical terminals depicted in FIG. 27.
Figure 29:
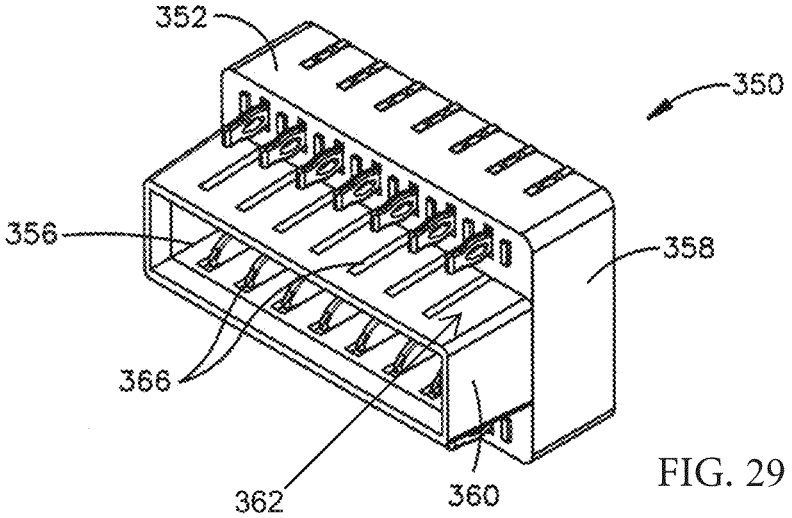
FIG. 29 is a perspective view from the opposite side of the electrical connector depicted in FIG. 28.

Referring now to FIGS. 27-29 a further alternate embodiment of electrical connector 240 is shown, namely electrical connector 350. In general, connector 350 is similar to connector 240 except for its rectangular shape. Given the rectangular shape, connector 350 can function as a card edge connector or as a power connector. Electrical connector 350 is shown to include a dielectric or electrically insulative connector housing 352 having a rectangular shape and a plurality of electrical terminals 244, described previously, supported by connector housing 352. Electrical terminals 244 are preferably arranged in opposed pairs so that the beams 258 of each pair of terminals are positioned facing opposite to one another.

Housing 352 defines an opening 354 to a receiving chamber 356. The width of opening 354 is preferably sized to permit passage of a card edge into chamber 356. Housing 352 includes a generally rectangular base portion 358 and a generally rectangular central portion 360 extending from base portion 358. Base portion 358 and central portion 360 together define chamber 356. Although portions 358 and 360 are shown to be monolithic, it should be appreciated, unless otherwise indicated, that such components can be separate from one another. Central portion 360 includes an outer surface 362 where the surfaces of the long sides are tapered so that, the outer surface of central portion 360 becomes narrower along the length of central portion 360 extending away from base portion 358. Housing 352 is also shown to define an angled surface 364 surrounding opening 354. Surface 364 also acts to locate and center a card or plug being inserted into connector 350.

The housing 352 defines a first end and a second end. The opening 354 extends from the first end to the second end such that a mating contact, card edge, flat substrate, planar substrate, tab, bus bar tab, circuit board or card 378 can pass through the first end of the housing 352 and extend beyond the second end. The opening 354 can be aligned with a coincident opening in the substrate, circuit board or bus bar 370 such that the mating contact, card edge, flat substrate, planar substrate, tab, bus bar tab, circuit board or card 378 can pass through both the connector 350 and a plane, any portion, upper surface or bottom surface of the circuit board or bus bar 370. An insertion depth of the mating contact, card edge, flat substrate, planar substrate, tab, bus bar tab, circuit board or card 378 may be defined by a length of circuit board or card 378 that extends perpendicularly beyond the plane or bottom surface of the circuit board or bus bar 370 after the mating contact, card edge, flat substrate, planar substrate, tab, bus bar tab, circuit board or card 378 is fully mated with the connector 350 in a mating direction. The bottom surface is a second surface of the circuit board or bus bar 370 penetrated by the circuit board or card 378 during insertion of the circuit board or card 378 into the housing 352 and the circuit board or bus bar 370. The insertion depth or length of the mating contact, card edge, flat substrate, planar substrate, tab, bus bar tab, circuit board or card 378 that extends from the bottom surface of the circuit board or bus bar 370 can be adjusted as necessary by adding stops to the housing 352 or the mating contact, card edge, flat substrate, planar substrate, tab, bus bar tab, circuit board or card 378. The upper surface of the circuit board or bus bar 370 is penetrated first by the mating contact, card edge, flat substrate, planar substrate, tab, bus bar tab, circuit board or card 378 during insertion of the mating contact card edge, flat substrate, planar substrate, tab, bus bar tab, circuit board or card 378 into the housing 353 and the circuit board or bus bar 370. Any portion means any penetration of the mating contact, card edge, flat substrate, planar substrate, tab, bus bar tab, circuit board or card 378 beyond the upper surface of the circuit board or bus bar 370 in an insertion direction.

Referring again to FIG. 23, a single electrical power terminal 244 is shown. Terminal 244 is an electrically conductive monolithic body. It should be appreciated, however, unless otherwise indicated, that various components of the terminal 244 can be separate from one or more other components of the terminal as desired. Preferably, the terminal 244 is constructed in a stamping operation. In such an operation sheet metal, which can be stainless steel, tin, copper, alloys including the same, or any alternative suitable electrically conductive material, is stamped to form the terminal 244. In one example, a plurality of terminals is formed from a single sheet of material and is supported by a common carrier strip. Thus, the stamped electrical terminals and the carrier strip can be monolithic with each other. The electrical terminals can be separated from the earner strip in the usual manner.

The power terminal 244 can include a base 256 and a contact beam 258 that extends from the base 256. Base 256 and contact beam 258 can be monolithic with each other. The contact beam 258 defines a contact portion 260 that is configured to contact a complementary electrical power terminal that is mated with the power terminal 244. The complementary power terminal can be supported by a plug housing of a plug connector that is received by a receptacle connector that includes the power terminal 244. The contact portion 260 includes a first side 262 and a second side 264. The first side 262 can be referred to as a first, contact side, and the second side 264 can be referred to as a second contact side. The first side 262 can be opposite the second side 264. For instance, the first side 262 can be spaced radially inward with respect to the second side 264 when the power terminal 244 is supported by connector housing 242. The first and second sides 262 and 264 can further be oriented at an angle relative to each other. For instance, the first side 262 can angled with respect to the second side 264. In one example, the first side 262 can be angled relative to the second side 264 such that the width of terminal 244 or the distance from the first side 262 to the second side 264 becomes greater in a direction away from base 256. Otherwise stated, the first side 262 can flare away from the second side 264 as it extends in a direction away from the base 256.

The contact beam 258 can further include an insertion portion 266 disposed at the end of power terminal 244 furthest from base 256. Thus, the contact portion 260 can be disposed between the base 256 and the insertion portion 266. The insertion portion 266 can define a first side 268 and a second side 270. The first side 268 can be referred to as a first insertion side, and the second side 270 can be referred to as a second insertion side. The first side 268 can be opposite the second side 270. For instance, the first side 268 can be spaced radially inward with respect to the second side 270 when the power terminal is supported by the connector housing 242. The first and second sides 268 and 270 can further be oriented at an angle relative to each other. In one example, the first side 268 can be angled relative to the second side 270 such that the width of terminal 244 or the distance from the first side 268 to the second side 270 becomes smaller along the insertion portion 266 in a direction away from base 256. It should thus be appreciated that the first side 262 of the contact portion 260 and the first side 268 of the insertion portion 266 join together at an interface that can be defined by an apex of the contact beam 258.

As described previously, electrical terminals 244 have tails 272 that are formed as press fit tails and which extend from base 256 in generally the same direction as contact beams 258. As shown in FIGS. 28 and 29, tails 272 extend from base portion 358 in generally the same direction as beams 258. It is noted that each terminal 244 is positioned within one of a plurality of slots 366 formed in housing 352. Although terminals 244 can be held within slots 366 in any number of ways, it is again noted that the terminals include a toothed surface having one or more teeth 368 (FIG. 33) for engaging an inner wail within base portion 358 of slot 366 and holding terminal 244 in place. It is noted that in order to allow beams 258 to flex upon insertion of a card or plug into cavity 356, the width of slot 366 within central portion 360 permits the movement of beam 258 within the slot. Although, slots or passages 366 are depicted, it should be understood that housing 352 could also be formed on terminals 244 by an over-molding operation without departing from the invention.

It should also be noted that in other applications, it is desirable to assemble connector 350 onto printed circuit boards and the like using surface mount techniques. Similar to the examples given previously, connector 350 could include terminals having tails that are directed away from base portion 358 at a sharp angle thereby providing a platform like arrangement to facilitate mounting connector 350 using surface mount techniques. It is also within the invention for the tails to include a shortened length or stub intended to cooperate with solder bails and the like to electrically connect terminal 244 to an electrical circuit.

Figure 30:
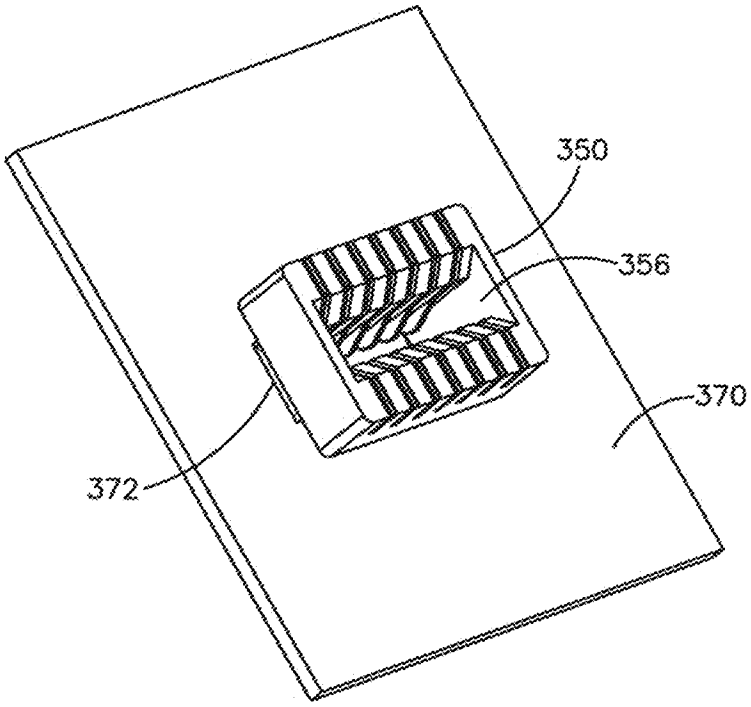
FIG. 30 is a perspective view of the electrical connector depicted in FIG. 28 mounted to a circuit board.
Figure 32:
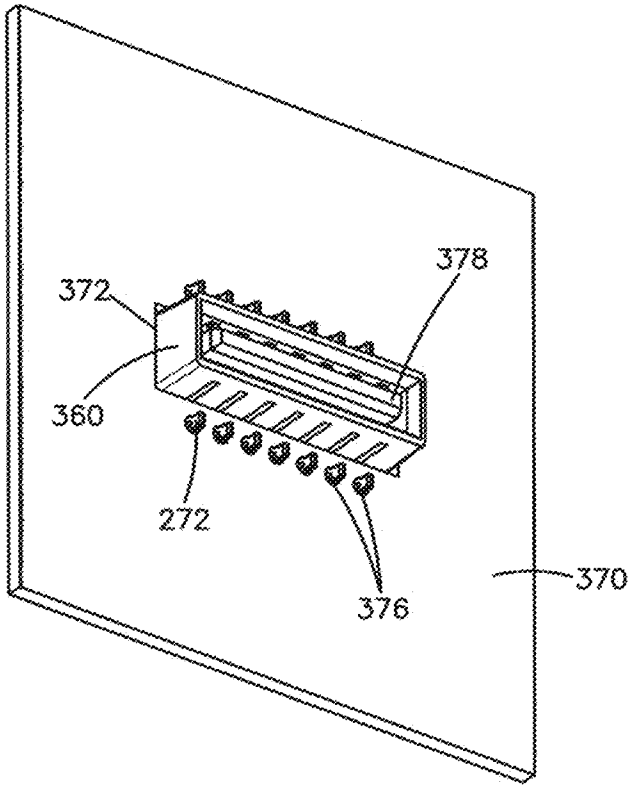
FIG. 32 is a perspective view from the underside of the mounted electrical connector depicted in FIG. 31.

Referring now to FIG. 30, electrical connector 350 is shown connected to a circuit board 370. As shown, central portion 360 passes through an opening 372 formed in board 370. Given that this particular embodiment includes terminals 244 having tails 272 formed as press fit tails, electrical connector 350 is mounted to circuit board 370 via a number of holes or vias 376 formed therein, an example of which is shown in FIG. 32. It should be understood that the diameter of any holes or vias formed in board 370 for receiving tails 272 should be small enough to permit the press fit tails to at least frictionally engage the inner surface of such holes or vias.

Figure 31:
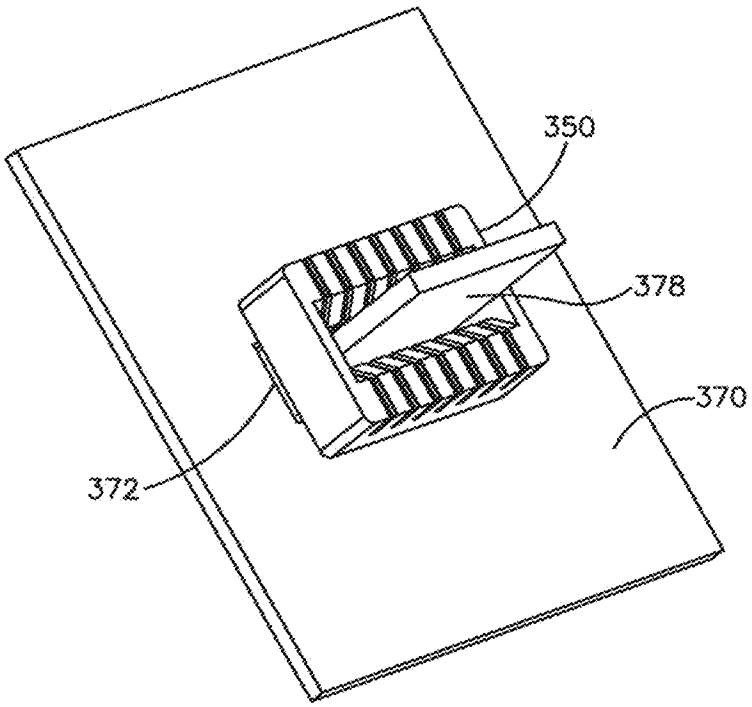
FIG. 31 is a perspective view of the electrical connector depicted in FIG. 30 with a circuit card inserted.
Figure 33:
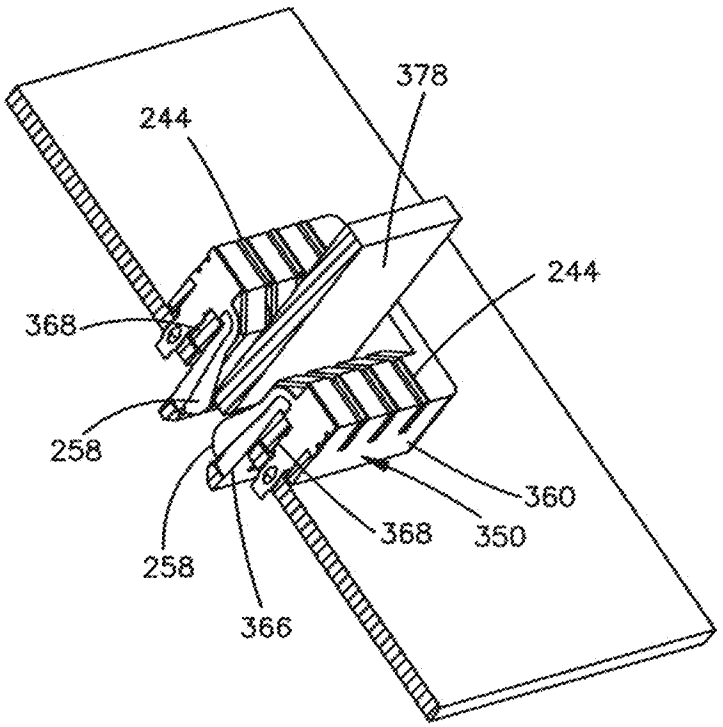
FIG. 33 is a perspective sectional view of the electrical connector depicted in FIG. 31, however, the circuit card has only been partially inserted.

Referring now to FIG. 31-32, an edge of a circuit board or card 378 has been inserted through opening 354 and into chamber 356. The dimensions of chamber 356 and the distance between pairs of opposed terminals 244 are set so that beams 258 engage card 378 during insertion into chamber 356. It should be understood that card 378 includes electrically conductive pads formed on one of both surfaces and are positioned such that as card 378 is inserted such pads will be wiped by beams 258 of terminals 244 thereby establishing an electrical connection between the pads and terminals 244. More particularly, as shown in FIG. 33, card 378 has only been partially inserted into connector 350 to the point where the leading edge of card 378 is making initial contact with opposed beams 258. As card 378 is further inserted, beams 258 will be deflected. Since terminal 244 is preferably stamped from metal, the deflection of beams 258 will result in a compression force for beams 258 to return to their initial position. This force contributes to the resulting wiping of beams 258 against pads formed on card 378 thereby establishing an electrical connection between card 378 and terminals 244.

The foregoing description is provided for the purpose of explanation and is not to be construed as limiting the invention. While various embodiments have been described it is understood that the words which have been used herein are words of description and illustration, rather than words of limitation. Although the embodiments have been described herein with reference to particular structures and methods, the invention is not intended to be limited to the particulars disclosed herein. Structures and methods described in association with one embodiment are equally applicable to all other embodiments described herein unless otherwise indicated. Those skilled in the relevant art, having the benefit of the teachings of this specification, may affect modifications to the invention as described herein, and changes may be made without departing from the spirit and scope of the invention, for instance as set forth by the appended claims.

What is claimed:

1. An electrical power connector comprising:

an electrically insulative connector housing defining a receiving chamber; and a plurality of electrical terminals supported by the connector housing, each of the plurality of electrical terminals including a contact beam including:

an insertion portion comprising a first insertion side and a second insertion side, the first insertion side being angled relative to the second insertion side;

a contact portion comprising a first contact side and a second contact side, the first contact side flaring away from the second contact side; and an interface where the first contact side and the first insertion side join together and define an apex of the contact beam;

wherein the plurality of electrical terminals are arranged in opposing groups of electrical terminals, wherein the electrical connector is configured to be mounted to a substrate and the plurality of electrical terminals are configured to extend through the substrate when the electrical connector is mounted to the substrate.

2. The electrical power connector of claim 1, wherein the first contact side of each electrical terminal is positioned facing the first contact side of another electrical terminal.

3. The electrical power connector of claim 1, wherein:

the plurality of electrical terminals are arranged in a plurality of rows comprising a first row of electrical terminals and a second row of electrical terminal; and the first row is parallel to the second row.

4. The electrical power connector of claim 3, wherein:

the receiving chamber is bounded by the electrically insulative connector housing on four sides comprising a first side and a second side;

the contact portions of electrical terminals of the first row of electrical terminals extend into the receiving chamber through the electrically insulative connector housing at the first side; and the contact portions of electrical terminals of the second row of electrical terminals extend into the receiving chamber through the electrically insulative connector housing at the second side.

5. The electrical power connector of claim 1, wherein:

the electrically insulative connector housing comprises a first end, a second end, and an opening that extends from the first end to the second end, and the opening permits a mating substrate or first circuit board or card to pass through the first end and extend beyond the second end.

6. The electrical power connector of claim 5, in combination with the substrate, wherein:

the substrate comprises an opening;

the substrate is a second circuit board or bus bar; and the opening of the housing is aligned with the opening in the mounting substrate, such that the mating substrate or first circuit board or card can pass through both the electrical connector and a portion of the second circuit board or bus bar.

7. The electrical power connector of claim 1, wherein:

each of the plurality of electrical terminals further comprises a base and a mounting portion; and the mounting portion curves away from the respective base at an angle.

8. The electrical power connector of claim 1, wherein:

each of the plurality of electrical terminals further comprises a base and a mounting portion; and the contact beam extends from the base in a first direction, and the mounting portion extends from the base in the first direction.

9. The electrical power connector of claim 1, wherein:

the contact beam comprises a widened portion.

10. An electrical power connector configured to be mounted to a substrate having a first side and a second side opposite the first side, the electrical connector comprising:

an electrically insulative connector housing defining a receiving chamber configured to receive a plug, the receiving chamber bound by an insulative wall of the housing; and a plurality of electrical terminals supported by the connector housing, each of the plurality of electrical terminals including:

a base;

a contact beam extending from said base, said contact beam including a contact portion, wherein the contact beam is configured to be exposed at the first side of the substrate when the electrical connector is mounted to the substrate; and a mounting portion that extends from said base and is monolithic with said base for mounting said terminal to the second side of the substrate;

wherein at least a portion of the terminal is disposed within said insulative wall and at least a portion of said contact portion extends from said insulative wall into said chamber.

11. The electrical power connector of claim 10, wherein the receiving chamber is configured to receive a cylindrical plug.

12. The electrical power connector of claim 10, wherein the contact beam further includes an insertion portion having first and second sides, said housing defines an opening to said receiving chamber, and said plurality of terminals are positioned in said housing so that said insertion portions are positioned proximate said opening wherein a distance between said first and second sides of said insertion portions become greater along said insertion portion in a direction from said opening toward said base.

13. The electrical power connector of claim 10, wherein said receiving chamber defines an insertion axis and wherein said beam extends away from said base at an angle towards said insertion axis.

14. The electrical power connector of claim 10, wherein said contact portion includes a first contact side and a second contact side, wherein said first contact side is at an angle relative to said second contact side wherein a distance between said first and second contact sides becomes greater along said contact portion in a direction away from said base.

15. The electrical power connector of claim 14, wherein the first contact side is linear along the direction away from said base.

16. The electrical power connector of claim 15, wherein the second contact side is linear along the direction away from said base.

17. The electrical power connector of claim 10, wherein each of the at least some electrical terminals further includes an insertion portion positioned at an end of said contact portion furthest from said base, wherein said insertion portion includes a first insertion side and a second insertion side, wherein said first insertion side is at an angle relative to said second insertion side.

18. The electrical power connector of claim 17, wherein a distance between said first and second insertion sides becomes smaller along said insertion portion in the direction away from said base.

19. The electrical power connector of claim 18, wherein said first insertion side has an arcuate shape oriented so that the distance between said first and second insertion sides becomes smaller in the direction away from said base.

20. The electrical power connector of claim 17, wherein the first insertion side is linear along the direction away from said base.

21. The electrical power connector of claim 17, wherein the second insertion side is linear along the direction away from said base.

22. An electrical power connector comprising:

an electrically insulative connector housing defining a receiving chamber; and a plurality of electrical terminals supported by the connector housing, each of the plurality of electrical terminals including a base, a mounting portion, and a contact beam, the contact beam including:

an insertion portion comprising a first insertion side and a second insertion side, the first insertion side being angled relative to the second insertion side;

a contact portion comprising a first contact side and a second contact side, the first contact side flaring away from the second contact side; and an interface where the first contact side and the first insertion side join together and define an apex of the contact beam;

wherein the plurality of electrical terminals are arranged in opposing groups of electrical terminals, the contact beam extends from the base in a first direction, and the mounting portion extends from the base in the first direction.

23. The electrical power connector of claim 22, wherein:

the mounting portion extends a first distance from the base in the first direction; and the contact beam extends a second distance from the base in the first direction, the second direction being greater than the first distance.

24. The electrical power connector of claim 23, wherein the mounting portion comprises a press fit tail configured to engage a hole formed in a substrate.

25. The electrical power connector of claim 22, wherein:

the contact beam comprises a widened portion.

26. The electrical power connector of claim 10, wherein:

the mounting portion extends a first distance from the base in a first direction; and the contact beam extends a second distance from the base in the first direction, the second direction being greater than the first distance.

27. The electrical power connector of claim 10, wherein:

the contact beam comprises a widened portion.

* * * * *